US005714920A

United States Patent [19]

Ivanov et al.

[11] Patent Number: 5,714,920

[45] Date of Patent: Feb. 3, 1998

[54] DIELECTRICALLY LOADED CAVITY RESONATOR

[75] Inventors: Eugene Nikolay Ivanov, Nedlands; David Gerald Blair, Guildford; Michael Edmund Tobar, Nedlands; Jesse Hyuck Searls, Fremantle; Simon John Edwards, Nedlands, all of Australia

[73] Assignees: Poseidon Scientific Instruments Pty Ltd.; The University of Western Australia, both of Australia

[21] Appl. No.: 343,595

[22] PCT Filed: Jun. 1, 1993

[86] PCT No.: PCT/AU93/00256

§ 371 Date: Nov. 30, 1994

§ 102(e) Date: Nov. 30, 1994

[87] PCT Pub. No.: WO93/24970

PCT Pub. Date: Dec. 9, 1993

[30] Foreign Application Priority Data

Jun. 1, 1992 [AU] Australia ..... PL 2720

[51] Int. Cl.[6] ..... H01P 7/00; H01P 7/10

[52] U.S. Cl. ..... 333/219.1; 333/227; 333/229; 333/234; 333/231

[58] Field of Search ..... 333/219, 219.1, 333/227, 228, 229, 230, 231, 234

[56] References Cited

U.S. PATENT DOCUMENTS

| | | | |
|---|---|---|---|
| 4,992,763 | 2/1991 | Bert et al. | 333/219 |
| 5,200,721 | 4/1993 | Mansour | 333/219.1 |

FOREIGN PATENT DOCUMENTS

| | | |
|---|---|---|
| 58-204601 | 11/1983 | Japan . |
| 58-204602 | 11/1983 | Japan . |
| 58-204603 | 11/1983 | Japan . |
| 6392103 | 10/1986 | Japan . |
| 62-183608 | 8/1987 | Japan . |
| 62-183609 | 8/1987 | Japan . |
| 62-183610 | 8/1987 | Japan . |
| 62-299102 | 12/1987 | Japan . |
| 62-299103 | 12/1987 | Japan . |
| 62-299104 | 12/1987 | Japan . |
| 63-92084 | 4/1988 | Japan . |
| 63-92101 | 4/1988 | Japan . |
| 260205 | 2/1990 | Japan . |
| 260206 | 2/1990 | Japan . |
| 260207 | 2/1990 | Japan . |
| 1688325A1 | 10/1991 | U.S.S.R. . |

OTHER PUBLICATIONS

1991 IEEE—*Resonant Frequencies of Higher Order Modes In Cylindrical Anisotropic Dielectric Resonators* by Michael E. Tobar and Anghony G. Mann, Department of Physics, University of Western Australia, pp. 143–146.

(List continued on next page.)

*Primary Examiner*—Benny Lee
*Assistant Examiner*—Darios Gambino
*Attorney, Agent, or Firm*—Bliss McGlynn, P.C.

[57] ABSTRACT

A method of producing a microwave resonator comprising a cavity (50) defined, at least in part, by a generally cylindrical wall (64) having an electrically conductive inner surface and containing a generally cylindrical piece of low loss dielectric material (22), characterized by forming a generally cylindrical piece of low loss dielectric material of predetermined size and placing same in a cavity to produce a microwave resonator which operates in a particular mode at a specific frequency at a particular temperature. Microwave radiation corresponding to a further operating mode is then passed into the cavity and then the frequency corresponding to the further operating mode is searched for and measured. A further generally cylindrical piece of dielectric material is produced by scaling from the first piece of dielectric material according to the ratio between the first and second frequencies. Then, the diameter and/or height of the cavity is varied to compensate for manufacturing inaccuracies in the crystal so as to obtain an output frequency close to the desired output frequency.

74 Claims, 20 Drawing Sheets

OTHER PUBLICATIONS

1990 Elsevier Science Publishers B.V. (North Holland)—*A Very High Stability Sapphire Loaded Superconducting Cavity Oscilator* by A.J. Giles, A.G. Mann, S.K. Jones, D.G. Blair and M.J. Buckingham, Department of Physics, University of Western Australia, pp. 145–146.

IEE Proc., vol. 129, Pt. H, No. 4, Aug. 1982—*Whispering–Gallery Modes of Dielectric Resonators* by C. Vedrenne and Prof. J. Arnaud, pp. 183–187.

1992 IEEE Frequency Control Symposium—*Microwave Frequency Discriminator With a Cooled Sapphire Resonator for Ultra–Low Phase Noise* by David G. Santiago and G. John Dick, California Institute of Technology, pp. 176–182.

*High–QT.E. Stabilised Sapphire Microwave Resonators and Low Noise Oscillators* by J.H. Searls, S. Edwards, E.N. Ivanov, M.E. Tobar, R. Woode, Dept. of Physics, University of Western Australia.

*Cryogenic Sapphire Microwave Resonator–Oscillator with Exceptional Stability* by A.N. Luiten, A.G. Mann and D.G. Blair.

*Low Noise, Microwave Siganl Generation Using Cryogenic, Sapphire Dielectric Resonators: An Update* by M.M. Driscoll and R.W. Weinert.

*A Low–Noise X–Band Gunn Oscillator Using a Sapphire Dielectric Resonator* by Sergey N. Bun'kov, Vladimir I. Konstantinov, and Vladimir L. Masalov.

1993 IEEE International Frequency Control Symposium—*Closed Loop Tests of the NASA Sapphire Phase Stabilizer* by David G. Santiago and G. John Dick, Jul. 1993, pp. 774–778.

1990 IEEE Transactions on Ultrasonics, Ferroelectrics, and Ferequency Control, vol. 37, No. 5, Sep. 1990. *Measurement and Analysis of a Microwave Oscillator Stabilized by a Sapphire Dielectric Ring Resonator for Ultra–Low Noise* by G. John Dick and Jon Saunders, pp. 339–346.

DIELECTRICALLY LOADED CAVITY RESONATOR

The present invention relates to a cavity resonator and dielectric and cavity thereof for use in high frequency signal source and signal processing systems, and also to a method for producing such cavity resonator. The invention has particular, although not exclusive, utility in such systems which operate in the microwave frequency band microwave resonator.

FIELD OF THE INVENTION

Modern radar and telecommunications systems require high frequency signal sources and signal processing systems with stringent performance requirements and extremely good spectral purity.

Thus, there is a need for signal processing systems and signal sources with ever increasing spectral purity, stability and power-handling requirements.

Resonators by their nature provide discrimination of wanted signals from unwanted signals. The purity and stability of the signals produced is directly linked to the resonator used as the frequency determining device and is dependent upon its Q-factor, power handling ability and its immunity to vibrational and temperature related effects.

It is known that a piece of dielectric material has self-resonant modes in the electromagnetic spectrum that are determined by its dielectric constant and physical dimensions. The spectral properties of a given mode in a piece of dielectric material are determined by the intrinsic properties of the dielectric material, its geometric shape, the radiation pattern of the mode and the properties and dimensions of the materials surrounding or near the dielectric.

Prior art resonators have traditionally relied on metallic cavities containing no dielectric material, or on metallic cavities containing a dielectric material which were limited in Q-factor by the properties of the metallic cavity and hence were operated at cryogenic temperatures in order to obtain a better Q-factor. However, to maintain cryogenic temperatures requires equipment which is cumbersome and difficult to incorporate into a portable or compact apparatus.

SUMMARY OF THE INVENTION

The present invention provides a microwave resonator operable at or near ambient temperatures whilst offering improved Q-factor over existing prior art resonators. In accordance with one aspect of the present invention there is provided a dielectric for a cavity resonator comprising a cylindrical portion to substantially confine electromagnetic energy therein and opposing axial ends particularly shaped to be fixedly disposed centrally within the cavity of the resonator.

Preferably the dielectric is formed of pure sapphire. Preferably, the dielectric has a diameter and a height determined by solving Maxwell's equations for a prescribed material intended to operate in a prescribed mode at a prescribed frequency, at a prescribed temperature.

In accordance with another aspect of the present invention, there is provided a cavity for a cavity resonator, including: a cylindrical wall; a pair of opposing axial ends; and a plurality of ports, at least one port being for delivering electromagnetic energy thereto and at least one other port being for receiving electromagnetic energy therefrom; wherein the opposing axial ends are particularly shaped to fixedly engage the opposing axial ends of a dielectric as defined in the preceding aspect of the invention and dispose the dielectric centrally therein.

In accordance with a further aspect of the present invention, there is provided a method for producing a cavity resonator, the method including the steps of (1) producing a first generally cylindrical piece of low loss dielectric material of predetermined size and placing same in a cavity to produce a microwave resonator;

(2) passing microwave radiation into the cavity;

(3) searching for and measuring an initial output frequency from the first piece corresponding to the desired operating mode at the particular temperature;

(4) producing a second generally cylindrical piece of dielectric material by scaling from the first piece of dielectric material according to the ratio between the initial and desired output frequencies; and (5) then producing a further cavity of substantially the same size as the first mentioned cavity but varying the diameter and/or height of the further cavity to compensate for manufacturing inaccuracies in the second piece so as to obtain an output frequency closer to the desired output frequency; and (6) placing the second piece in the further cavity to produce the microwave resonator operating in the desired mode and at the desired frequency.

BRIEF DESCRIPTION OF THE DRAWINGS

The present invention will now be described, by way of example, with respect to several discrete embodiments. The description is made with reference to the accompanying drawings, in which.

DESCRIPTION OF THE INVENTION

Figure 1A:
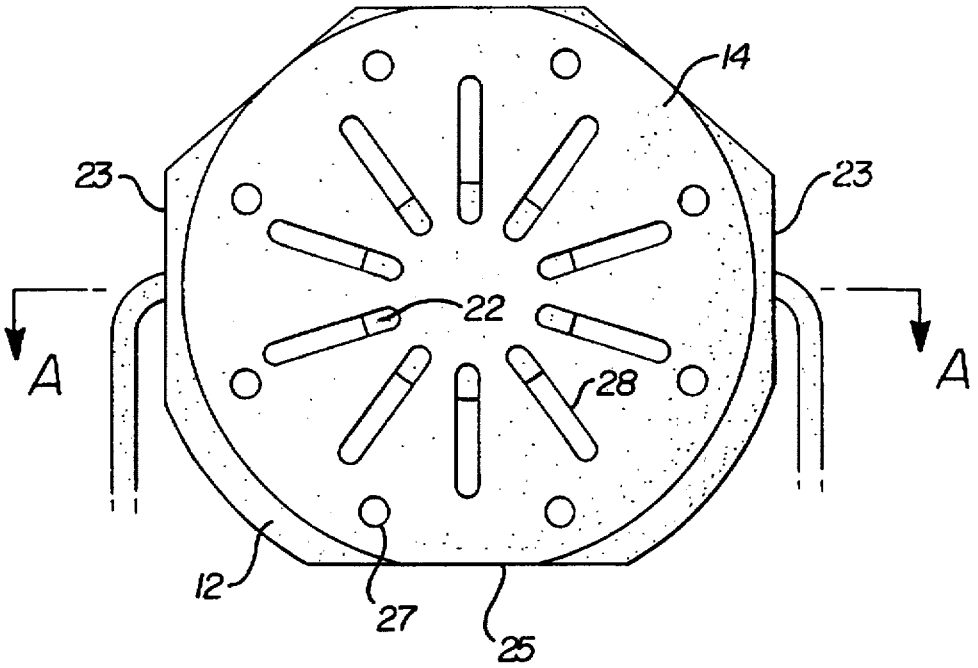
FIG. 1A is an underside view of a microwave resonant cavity in accordance with a first embodiment of the present invention.

In FIG. 1 of the accompanying drawings, there is shown a microwave resonant cavity 10 in accordance with the present invention. The microwave resonant cavity 10 comprises a cylindrical wall 12, a circular base 14 and a circular lid 16.

Within the cylindrical wall 12 there are a number of microwave ports 18. The number of ports 18 depends upon the application for which the microwave resonant cavity 10 is intended to be used. In the present embodiment there are two diametrically opposed ports. The microwave ports 18 provide means for delivering the microwave into the cavity 10 and for receiving microwaves from the cavity 10. The 12 cylindrical wall 12 has formed therein holes 26 to provide means for mounting the cavity 10.

Each of the base 14 and lid 16 contains an axial recess 20 and an annular groove 21. The axial recess 20 and the cylindrical wall 12 are aligned co-axially. The annular grooves 21 accommodate a gasket, such as an indium gasket, to improve thermal conductivity between the cylindrical wall 12 and the base 14 and the lid 16.

Shown in FIG. 1A is an underneath view of the base 14. However, it is to be appreciated that the diagram is equally applicable to the lid 16. The base 14 is provided with a plurality of holes 27 arranged in a circle and radial slots 28. The holes 27 are for mounting the base 14 to the cylindrical wall 12 by any convenient means, such as bolting. The radial slots 28 inhibit unwanted modes within the cavity 10. The number of radial slots 28 is dependent upon the resonant mode in which the cavity 10 is intended to operate.

The cylindrical wall 12 has a surface 25 for mounting the cavity 10 to a cooling means. There is also a flat surface 23 for each port 18 to facilitate mounting a microwave probe into the port 18.

The resonant cavity 10 contains a generally cylindrical piece of dielectric material 22. The piece of dielectric material 22 is provided with an integral axial spindle 24 at each flat end of the cylinder. The spindles 24 are also formed of the dielectric material 22. The spindles 24 are designed to be accommodated within the recesses 20 of the lid 16 and base 14. Thus, the piece of dielectric material 22 is held between the lid 16 and the base 14 co-axially with the cylindrical wall 12.

FIGS. 2,3 and 4 show alternative embodiments to the microwave cavity resonator shown in FIG. 1, with like reference numerals denoting like parts.

Shown in 2A and 2B is a second embodiment of a microwave 18 resonant cavity 30 in accordance with the present invention comprising a left section 32 and a right section 34. Each of the sections 32 and 34 contains an inner half cylindrical surface 31. A rod 36 or stem of semicircular cross-section extends from each flat end of the section 32 inwards into the cavity 30A to terminate in a free end. A rod 38 of semicircular cross-section extends from each flat end of the section 34 inwards into the cavity 30A to terminate in a free end.

The rods 36 are formed integrally with the section 32 and the rods 38 are formed integrally with the section 34. The rods 36 and 38 are aligned co-axially with the cylindrical surface 31 and each rod 36 is contiguous with the corresponding rod 38. The free end of each pair of rods 36 and 38 has an axial recess 40 formed therein.

The spindles 24 of the piece of dielectric material 22 are accommodated within the recesses 40 of the rods 36 and 38. Hence, the dielectric material 22 is held between the rods 36 and 38 co-axially with the cylindrical surface 31. The use of the sections 32 and 34 instead of the lid 16, base 14 and cylindrical wall 12 of the embodiment shown in FIG. 1 provides increased suppression of unwanted modes within the cavity 30, as well as providing improved thermal conduction from the piece of dielectric material 22 to a cooling means.

Figure 3A:
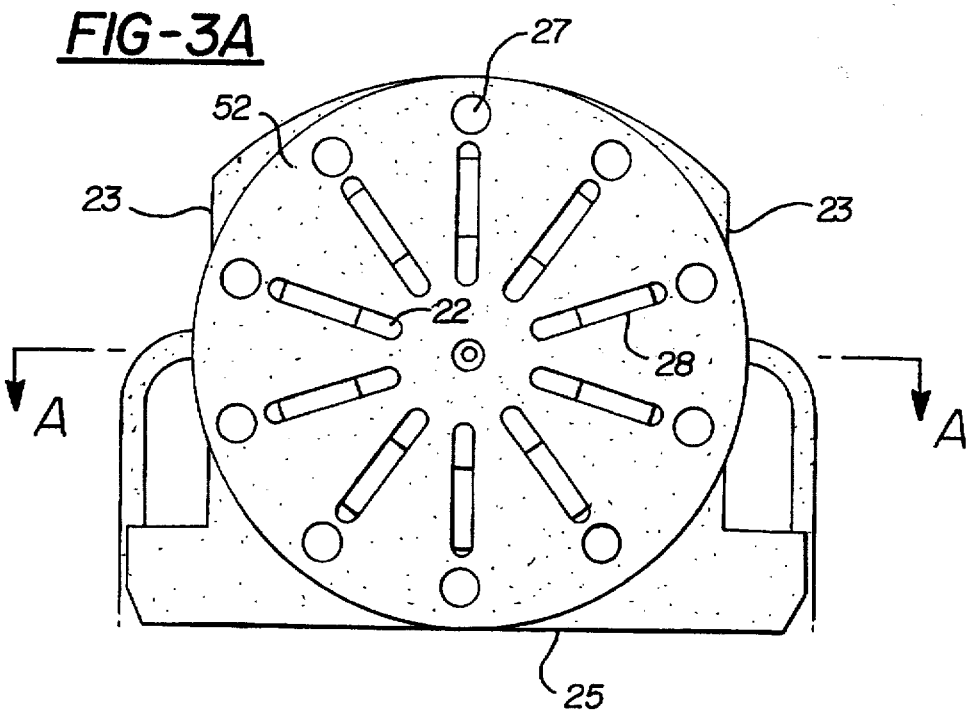
FIG. 3A is an underside view of a microwave resonant cavity in accordance with a third embodiment of the present invention.
Figure 3B:
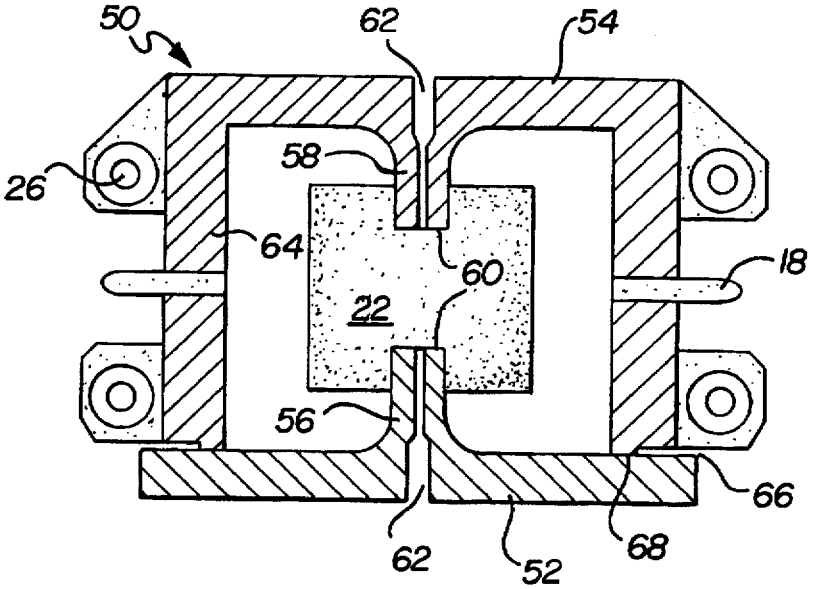
FIG. 3B is a sectional side view taken along the section A—A of FIG. 3A.

Shown in FIGS. 3A and 3B is a third embodiment of a microwave resonant cavity 50 in accordance with the present invention comprising a lid 52 and a base 54. The base 54 has formed integrally therewith a cylindrical wall 64. Coaxial rods or stem 56 and 58 of circular cross-section extend from the lid 52 and the base 54 respectively into the cavity 50 to terminate in free ends. The rod 56 is formed integrally with the lid 52 and the rod 58 is formed integrally with the base 54. The piece of dielectric material 22 has formed therein axial recesses 60 at the top and bottom of the piece of dielectric material 22. The rods 56 and 58 are accommodated within the axial recesses 60 of the piece of dielectric material 22, holding the piece of dielectric material 22 co-axial with the cylindrical wall 64. Each of the rods 56 and 58 has formed therein an axial vent 62. The axial vent prevents any air being trapped in the axial recesses 60 when the cavity 50 is evacuated.

The cylindrical wall 64 has an annular projection 68 to provide a good contact with the lid 52. A space 66 is formed between the projection 68, the lid 52 and the cylindrical wall 64. The space 66 is designed to accommodate a gasket, ensuring a good thermal contact between the cylindrical wall 64 and the lid 52.

Figure 4A:
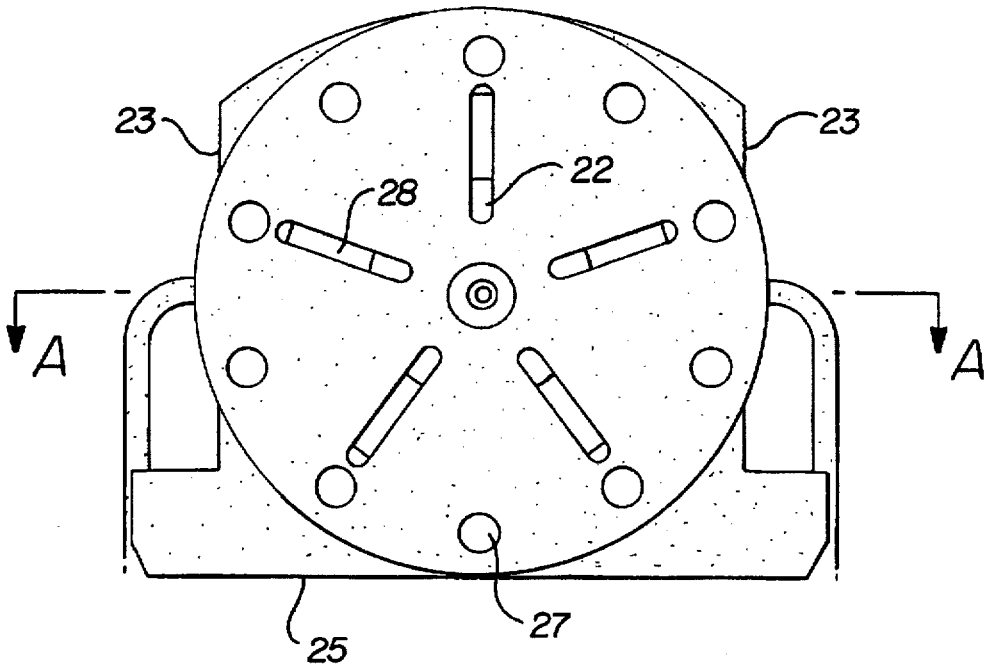
FIG. 4A is an underside view of a microwave resonant cavity in accordance with a fourth embodiment of the present invention.
Figure 4B:
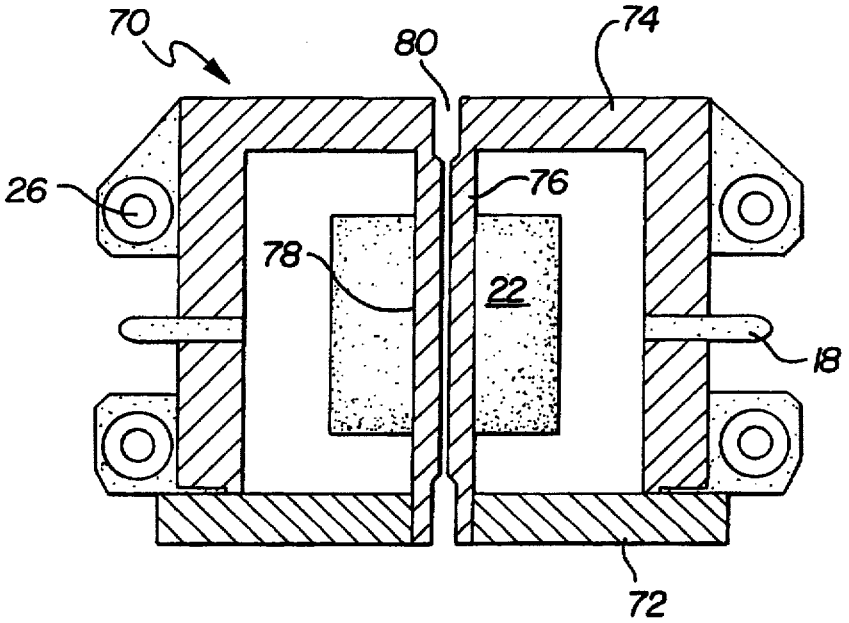
FIG. 4B is a sectional side view taken along the section A—A of FIG. 4A.

FIGS. 4A and 4B shows a fourth embodiment of a microwave resonant cavity 70 in accordance with the present invention comprising a lid 72 and a base 74 having a flat end. The base 74 has formed integrally therewith a cylindrical wall 82. Extending from the flat end of the base 74 into the cavity 70 is a co-axial cylindrical rod or stem 76. The rod 76 is long enough to extend through to the lid 72 and, as shown, to be integrally formed with the lid 72. Extending through the rod 76 is a hole 80. The hole 80 allows a temperature probe to be placed within the rod 76 close to the piece of dielectric material 22.

The piece of dielectric material 22 has an axial cylindrical hole 78 formed therein. The piece of dielectric material 22 is designed to be suspended on the rod 76 as shown in FIG. 4. The suspension of the piece of dielectric material 22 on the cylindrical rod 76 is achieved by one of the following means.

Firstly, the axial cylindrical hole 78 formed in the piece of dielectric material 22 may be of a slightly smaller diameter than the cylindrical rod 76. By cooling the cylindrical rod 76 to a low temperature, the thermal contraction of the cylindrical rod 76 allows the dielectric material 22 to be placed in position over the cylindrical rod 76. As the cylindrical rod 76 returns to ambient temperature, it will expand due to thermal effects, thus holding the piece of dielectric material 22 along its length.

Alternatively, the hole 78 in the piece of dielectric material 22 may be plated with a metallic material. It is then possible to weld or solder the piece of dielectric material 22 to the rod 76.

The slots 28 in the cavities 10, 30, 50 and 70 of each of the aforementioned embodiments are designed to supress unwanted modes within the cavity. The slots 28 are placed at positions around the lid of the cavity which do not interfere with the desired operating mode. This corresponds to positions at which there is a low concentration of electromagnetic energy in the desired operating mode. Many of the undesirable modes will have a considerable amount of energy at these positions, thus the slots 28 will act as suppressors for these modes. The effect of the slots 28 is to make the cavity non-radiating with respect to the desired operating mode and radiating with respect to most undesired modes. Hence the slots 28 help reduce the density of unwanted modes in the resonator.

One of the losses in a microwave resonant cavity is due to dissipation of the electromagnetic field within the dielectric material. This dissipation causes heat build up within the dielectric material. Most dielectric materials have a resonating frequency dependent upon temperature. That is, the resonant frequency of the dielectric material will change as temperature changes. Hence, it is undesirable to have the dielectric material change in temperature during operation. For this reason, it is necessary to dissipate the heat built up in the dielectric material as a result of dissipation of the electromagnetic field within the dielectric material. Therefore, it is desirable to have the lid, the cylindrical wall and the base of the microwave resonant cavities of the present invention formed of a material having good thermal conductivity.

Having the lid base and walls of the resonant cavities of the present invention made of material with high thermal conductivity allows cooling of the cavity by any convenient means. However, there remains the inherent problem that the transfer of heat between the dielectric material and the base and lid of the cavity may take a considerable period of time. Hence, it is desirable to ensure that the design of the cavity allows the heat to be transferred as efficiently as possible.

Figure 1B:
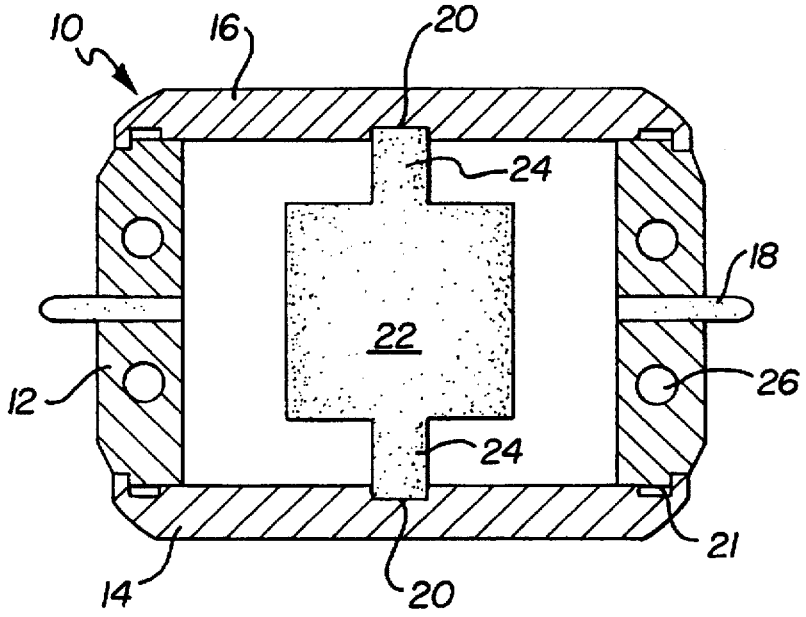
FIG. 1B is a sectional side view taken along the section A—A of FIG. 1A.

The microwave resonant cavity 10 the first embodiment shown in FIGS. 1A and 1B, while offering excellent immunity to mechanical vibrations since the piece of dielectric material 22 is held securely between the lid 16 and the base 14, offers relatively poor thermal properties. This is because the spindles 24 are relatively long and thin compared to the cylindrical portion of the piece of dielectric material 22. The spindles 24 are thus effectively a very high thermal impedance, slowing the transfer of heat from the cylindrical portion of the piece of dielectric material 22 to the lid 16 and base 14.

Figure 2A:
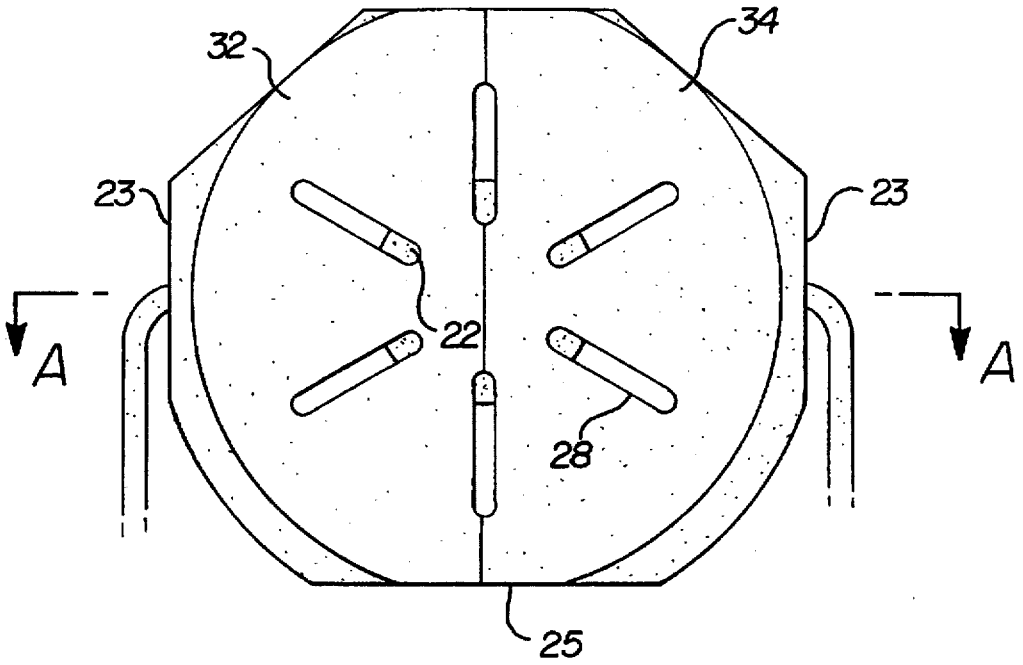
FIG. 2A is an underside view of a microwave resonant cavity in accordance with a second embodiment of the present invention.
Figure 2B:
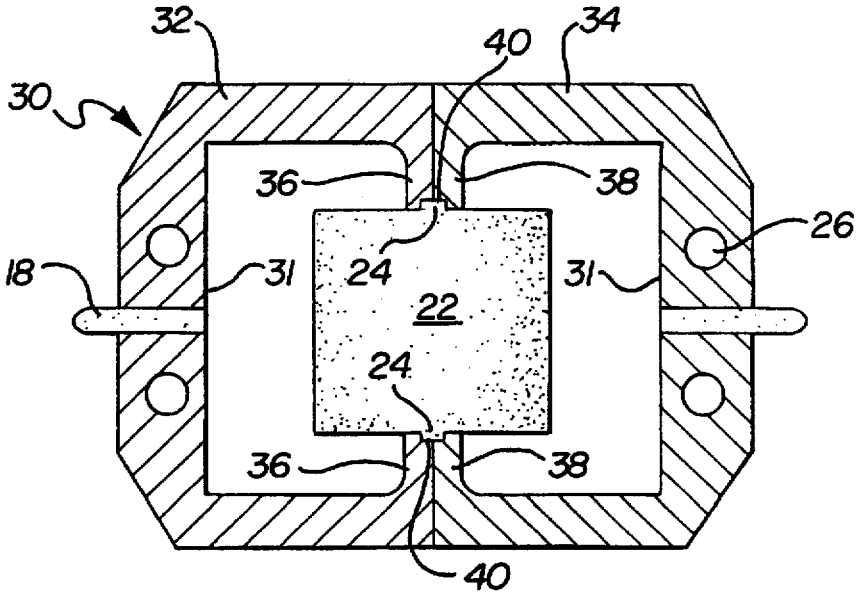
FIG. 2B is a sectional side view taken along the section A—A of FIG. 2A.

The microwave resonant cavity 30 shown in FIGS. 2A and 2B offers an improvement in thermal properties in that the rods 36 and 38, made of the same material as the lid 32 and base 34, replace most of the spindles 24 of FIG. 1. Thus, the spindles 24 are relatively small and are retained mainly for the purpose of holding the piece of dielectric material 22 co-axial with the cylindrical wall 12.

A further improvement may be achieved by the microwave resonant cavity 50 shown in FIGS. 3A and 3B. Here, the rods 56 and 58 extend into the piece of dielectric material 22, thus eliminating the need for spindles. Further, the thermal conductivity between the rods 56 and 58 and the dielectric material 22 is improved since the rods extend into the piece of dielectric material 22 and are thus closer to the heat to be dissipated. The microwave resonant cavity 50 still offers good resistance to mechanical vibration since the dielectric material 22 is held between the rods 56 and 58.

The microwave resonant cavity 70 shown in FIGS. 4A and 4B offers the best thermal dissipation of the four embodiments illustrated in FIGS. 1 to 4. This is due to the presence of the rod 76 extending entirely through the piece of dielectric material 22. Thus, heat from the dielectric material is transferred directly into the rod 76 allowing the maximum possible dissipation of heat. However, since the dielectric material is suspended on the rod 76 purely by thermal expansion, the microwave resonant cavity 70 does not offer the same resistance to mechanical vibration as do the microwave resonant cavities shown in FIGS. 1,2 and 3.

Figure 5:
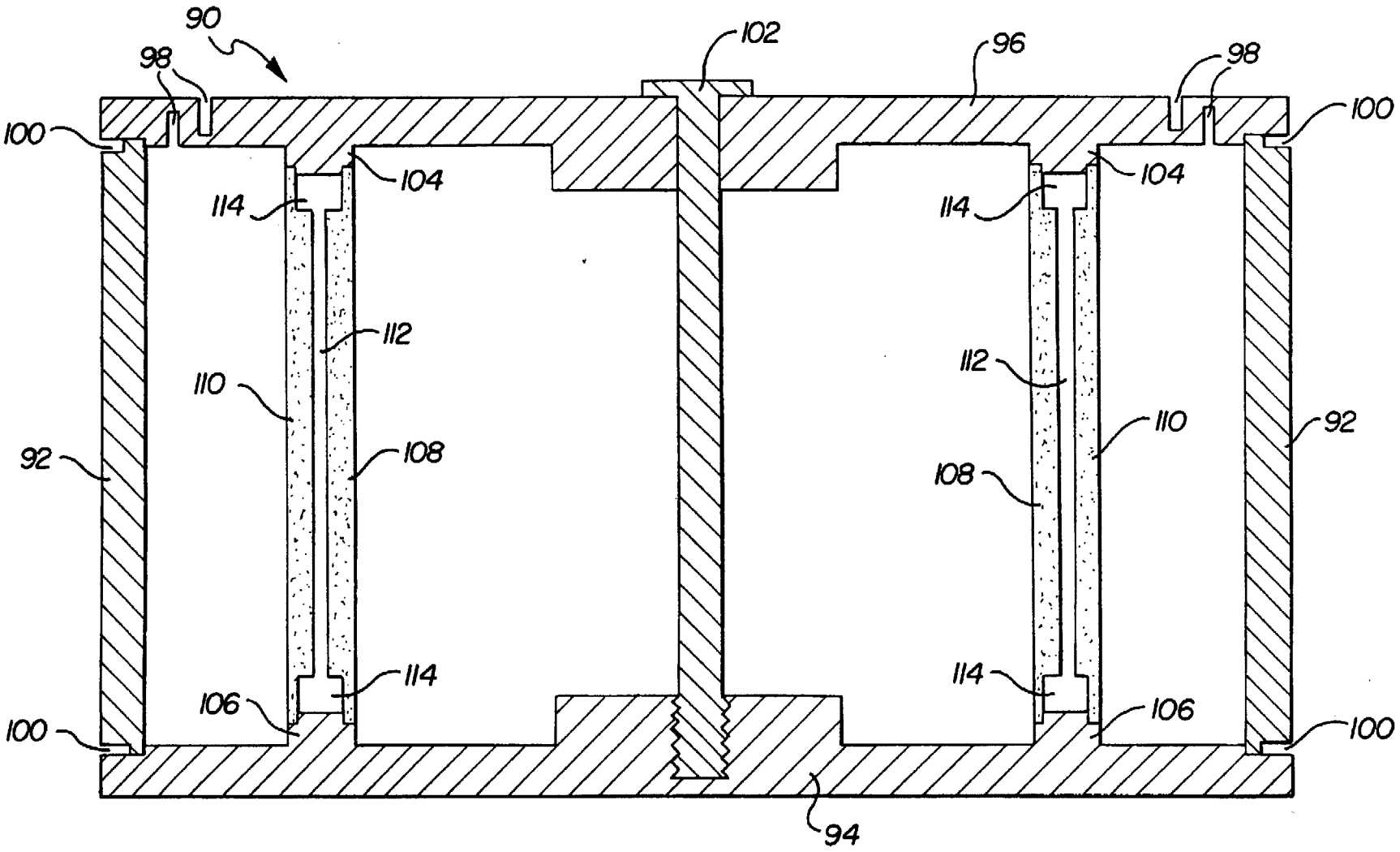

Shown in FIG. 5 is a fifth embodiment of a microwave resonant cavity 90 in accordance with the present invention comprising a cylindrical wall 92, a base 94 and a lid 96. The lid 96 has internal and external concentric annular sections or recesses 98 removed as shown. Also, the cylindrical wall 92 has external sections or annular 100 recesses at both its upper and lower ends. The sections 98 are removed to allow for thermal contraction and expansion if the resonant cavity 90 is operated at cyrogenic temperatures. The sections 100 are removed to help provide good electrical contact, via a knife edge effect, between the cylindrical wall 92 and the lid 96 and the base 94.

The resonant cavity 90 further comprises a locking means 102, a first circular projection 104, a second circular projection 106 and inner and outer concentric cylindrical pieces of dielectric material 108 and 110, respectively. The locking means 102 is designed to pass axially through the lid 96 and to engage the base 94 by any convenient means, such as threadedly. The locking means 102 holds the base 94 and the lid 96 in place between the cylindrical wall 92 and also holds the pieces of dielectric material 108 and 110 between the projections 104 and 106.

The projection 104 extends into the resonant cavity 90 and has an annular form with a largely rectangular cross-section. The corners of the projection 104 extending innermost into the resonant cavity are removed to accommodate the pieces of dielectric material. The projection 104 is formed integrally with the lid 96 and is co-axial therewith. The projection 106 is formed integrally with the base 94 and in all other respects is the same as the projection 104. The pieces of dielectric material 108 and 110 have a substantially constant thickness throughout their length. However, at each end of the cylinder, the thickness of the dielectric material 108 and 106 is to define a cylindrical lip. When the pieces of dielectric material 108 and 110 are placed within the cavity and held between the projections 104 and 106, there is formed a gap 112 between the two pieces of dielectric material 108 and 110. At the ends close to the projections 104 and 106 where the thickness of the pieces of dielectric material 108 and 110 is decreased there is formed a broader gap 114. The function of the gap 114 is to present a substantially increased electromagnetic impedance to the microwave energy, by appearing as a waveguide operating below the cut-off frequency, to confine it between the gaps 114.

Figure 12A:
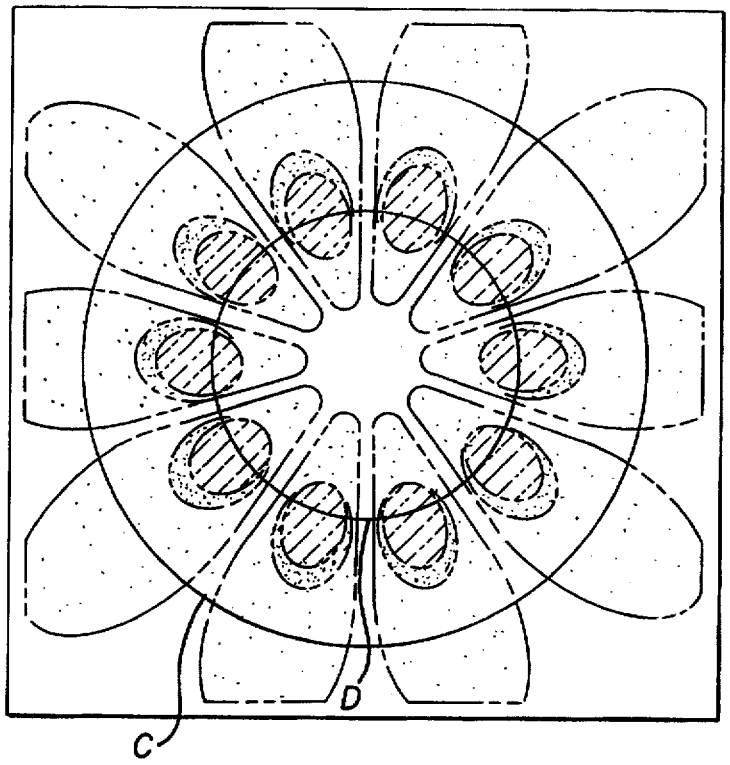
FIG. 12A shows a plan view plot of the electromagnetic field strengths of a dielectrically loaded microwave resonant cavity operating in TM(5,1,d) mode.
Figure 12B:
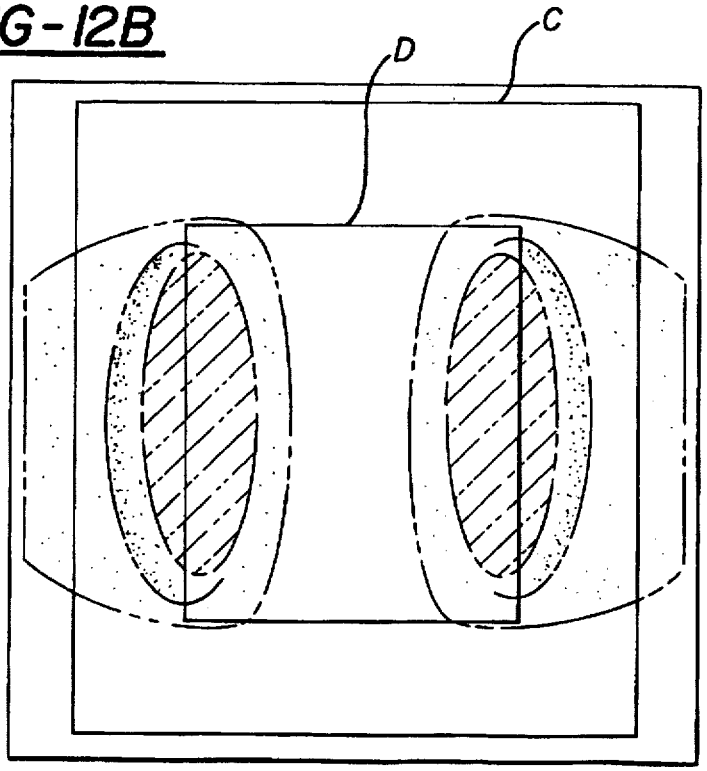
FIG. 12B shows a side view plot corresponding to FIG. 12A.

The function of the gap 112 is to reduce the effects of losses within the dielectric material from which the pieces of dielectric material 108 and 110 are formed. FIGS. 12A and 12B of the accompanying diagrams show pictorially the distribution of the electromagnetic field within a dielectric material operating in TM(5,1,d) mode. Dark areasindicate a high concentration of electromagnetic radiation and light areas indicate a low concentration of electromagnetic radiation. The boundary of the cavity is shown by the black lines labelled "C". The boundary of the dielectric material is shown by the black lines labelled "D". FIG. 12A shows a plan view of the dielectric material FIG. 12B shows a side view of the dielectric material. As can be seen in FIGS. 12A and 12B, the majority of the electromagnetic radiation is contained with in the dielectric material. It is also to be noted that there is negligible electromagnetic radiation within the centre of the dielectric material. Hence, it is possible to remove the central dielectric material without impeding the operation of the resonator.

Figure 13A:
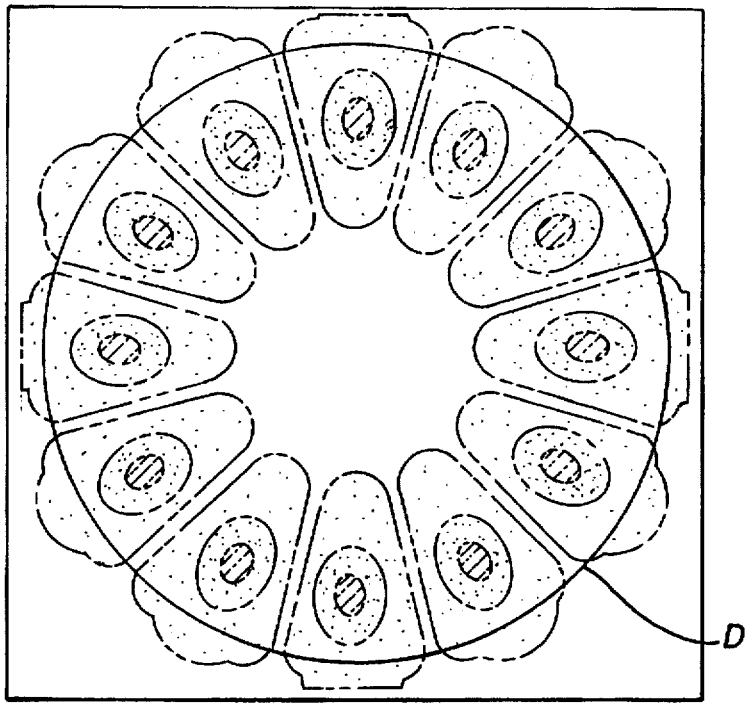
FIG. 13A shows a plan view plot of the electromagnetic field strengths of a dielectrically loaded microwave resonant cavity operating in TE(6,1,d) mode.
Figure 13B:
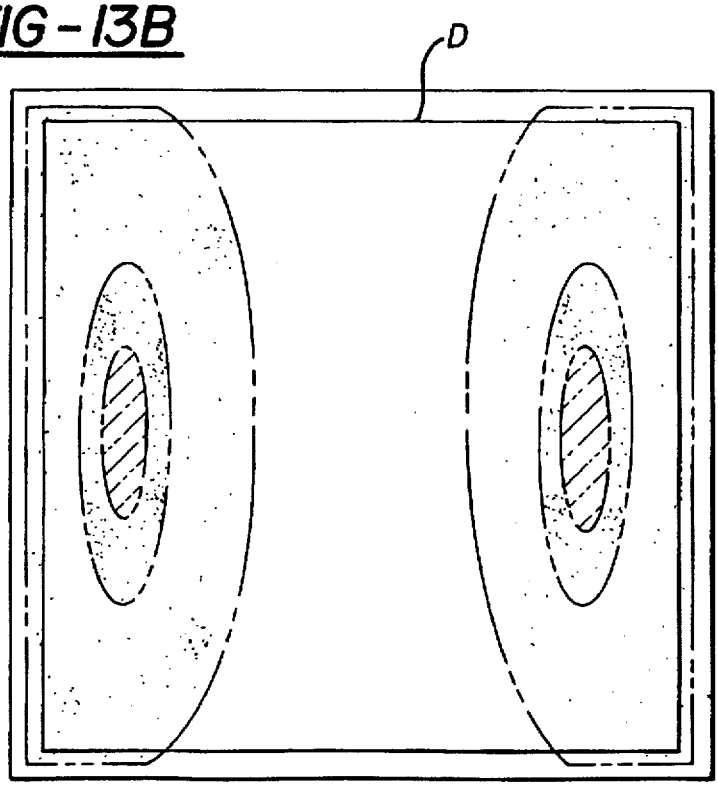
FIG. 13B shows a side view plot corresponding to FIG. 13A.

FIGS. 13A and 13B are a pictorial representation of the electromagnetic field distribution within a dielectric material operating in TE(6,1,d) mode. The boundary of the dielectric material is shown by the black lines labelled "D". As can be seen to accommodate the increased number of modes, the piece of dielectric material has had to be increased in size for the same frequency of electromagnetic radiation. Also, more of the electromagnetic radiation is contained within the dielectric material.

Examining FIGS. 12A, 12B, 13A and 13B it becomes apparent that most of the electromagnetic radiation is contained within a relatively narrow annulus. Thus, it is possible to form two concentric cylinders of dielectric material to contain the electromagnetic radiation whilst allowing the space between to be free space. It is well known that free space is a lossless media for electromagnetic radiation. Hence, the pieces of dielectric material 108 and 110 serve to confine the electromagnetic radiation in a similar manner to the other cavities in the other embodiments of the present invention, however, the gap 112 also allows for a substantial decrease in the losses associates with these cavities. This is because the majority of the electromagnetic radiation is confined within the gap which is a lossless media. Hence, the Q factor of the resonator cavity 90 is better than that of the other embodiments of the present invention.

It is also envisaged that the gaps 112 and 114 could be filled with a suitable material to allow the functioning of a MASER. Such suitable material would be, for example, Rubidium gas, or excited hydrogen gas.

The performance of a microwave resonant cavity is largely determined by the geometries of the microwave resonant cavity and the piece of dielectric material 22.

Specifically, the following measurements have been found to be relevant to resonator performance:

a) the diameter of the piece of dielectric material 22, b) the height of the piece of dielectric material 22, c) the ratio of the diameter of the piece of dielectric material 22 and the diameter of the inner face of the cylindrical wall 12, and d) the ratio of the height of the piece of dielectric material 22 and the height of the cylindrical wall 12.

Further, the Q-factor of a dielectric resonator is determined by losses due to dissipation of the electromagnetic field in the dielectric material, radiation of the electromagnetic field into the surrounding space and of the electromagnetic field in the cavity walls.

It is known that radiation losses are reduced for certain resonant modes. Of the multitude of electromagnetic modes one of the most favoured for the reduction of radiation losses is a group known as "whispering gallery" modes. For these modes most of the electromagnetic field is contained within the dielectric material, reducing radiation losses. In particular, the modes preferred for use in the present invention are Quasi Transverse Electric modes, TE(N,1,d), Quasi Transverse Magnetic Modes, TM(N,1,d) and Quasi Transverse Hybrid Modes, N=3 to infinity, preferably 3 to 20, more preferably 4 to 7. The value of N chosen, and hence the resonant mode chosen, and the frequency of operation of the resonator, affect the determination of the dielectric material geometry.

Figure 10:
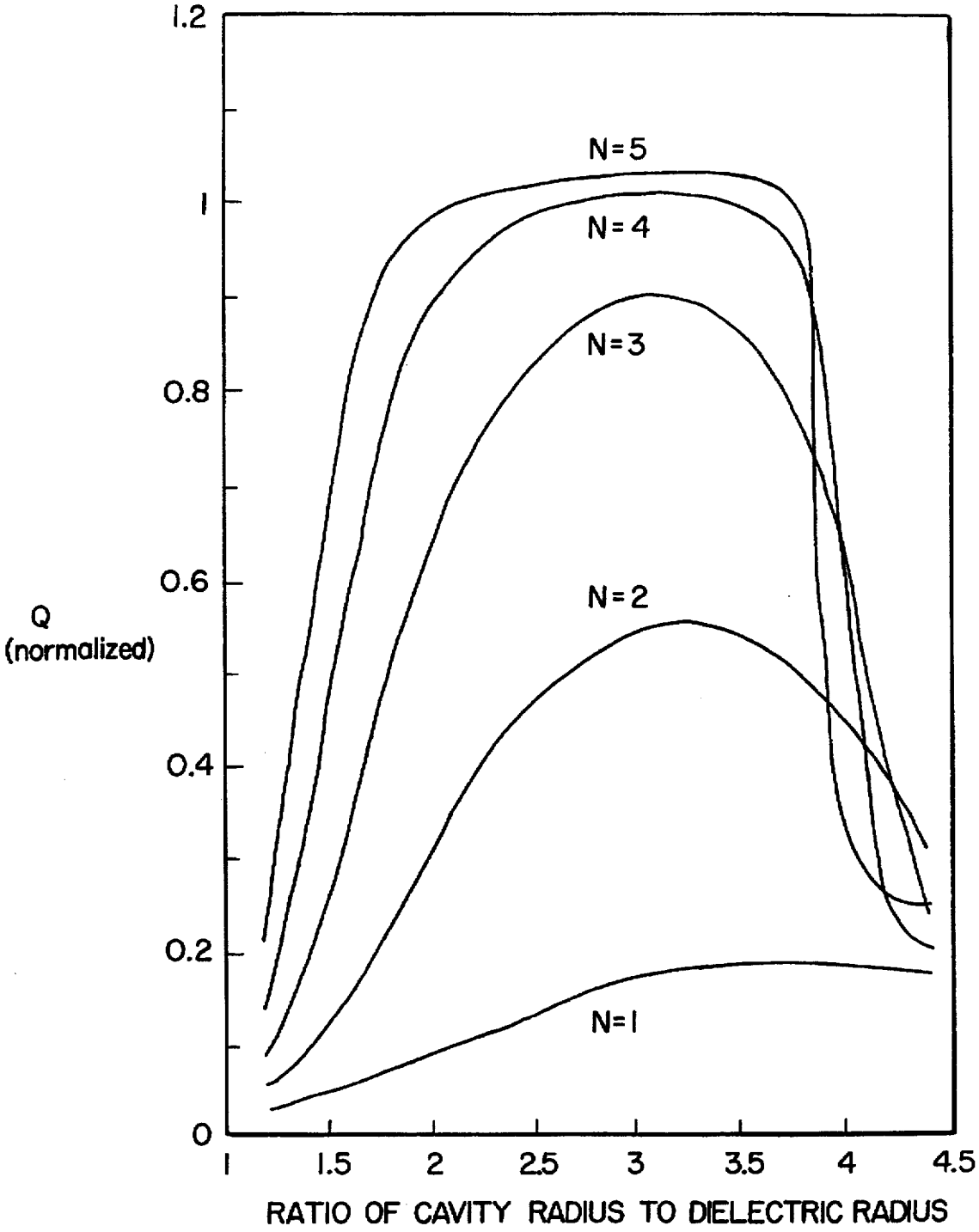
FIG. 10 is a graph showing the losses within a microwave resonators operating in various TM(N,1,d) modes for N between 1 and 5 as the ratio of the radii of the piece of dielectric material and the cavity walls changes.

FIG. 10 shows for TM(1,1,d) to TM(5,1,d) the normalised maximum Q factor obtainable for a cavity resonator for various ratios of the radii of the cavity to the diameter of the piece of dielectric material. The normalized Q-factor is equal to the measured Q of the resonator divided by the loss tangent of the dielectric. The curves in FIG. 10 are for a sapphire dielectric material in a cavity with copper walls. As can be seen for low values of N, especially N less than or equal to 3 there are appreciable losses due to the interaction of the electromagnetic mode with the cavity walls, or radiation of the electromagnetic field into free space. Further, it is also apparent that N=5 is the only mode shown on the graph for which the normalised Q factor is greater than or equal to 1. Hence, it is preferable that the mode chosen for transverse magnetic modes is at least TM(5,1,d). This choice allows the maximum Q factor obtainable from the dielectric material to be achieved within the cavity, allowing for other limitations.

However, as the mode number increases so does the size of the dielectric material needed to accommodate it, for the same resonant frequency. Thus, it is optimal to choose, for transverse magnetic modes, N equal to five to give the maximum Q factor obtainable from the piece of dielectric material whilst having the cavity the minimum possible size.

Figure 11:
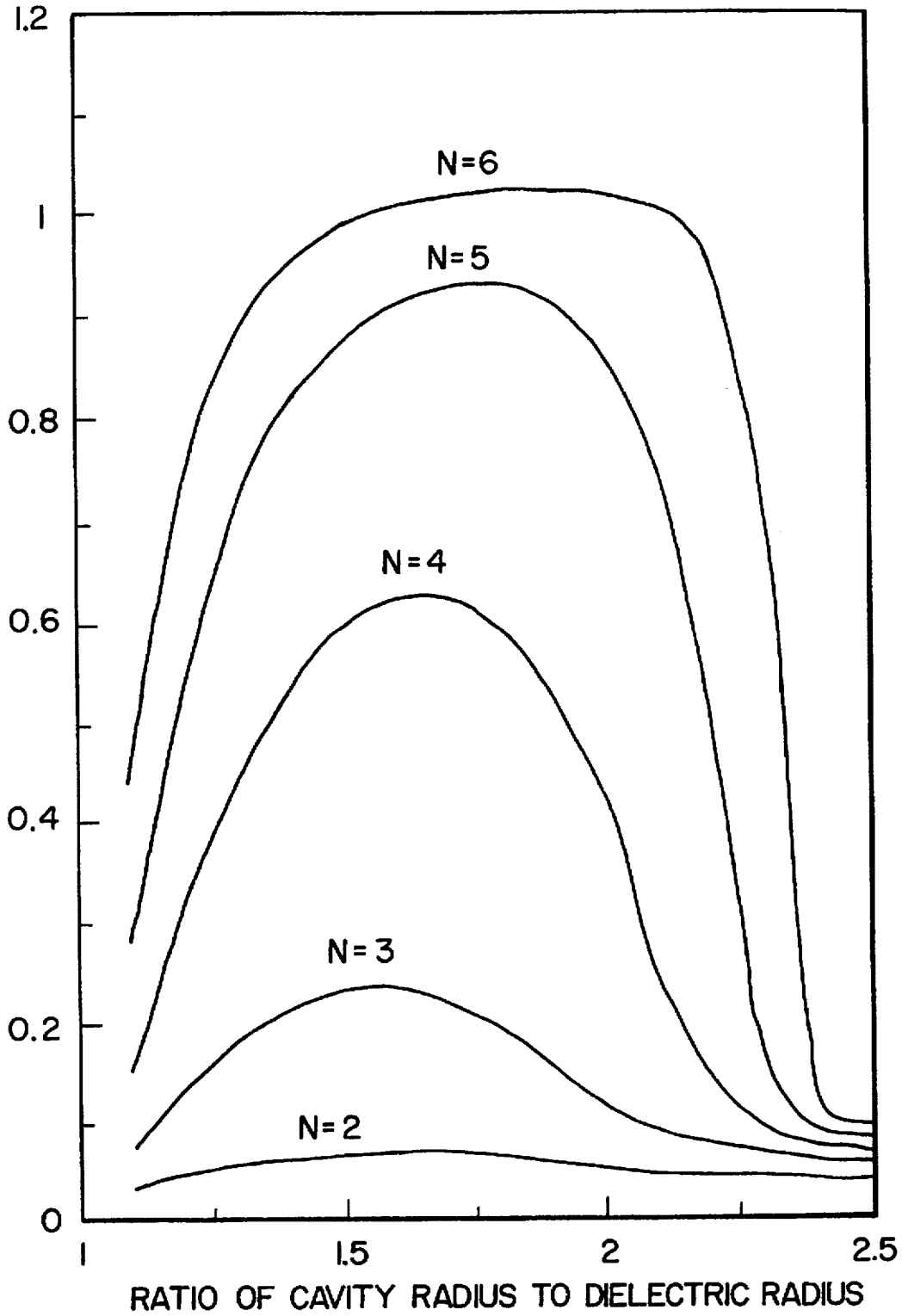
FIG. 11 is a graph showing the losses within a microwave resonator operating in various TE(N,1,d) modes for N between 2 and 6 as the ratio of the radii of the piece of dielectric material and the cavity walls changes.

FIG. 11 shows a normalized graph of the Q factor obtainable within a cavity for transverse electrode modes TE(2,1,d) to TE(6,1,d) for various ratios of radii of the cavity and the piece of dielectric material. The curves in FIG. 11 are for a sapphire dielectric material in a cavity with copper walls approximately 25 degrees C. The vertical axis represents the normalised Q factor obtainable and the horizontal axis is the ratio between the radius of the cavity and the radius of the dielectric material. As can be seen from this graph, it is necessary to operate in TE(6,1,d) to obtain the maximum Q factor available for the dielectric material within the resonant-cavity. Hence, for a microwave resonant cavity operating in transverse electric mode, it is preferable to operate in TE(6,1,d) mode to obtain the maximum Q factor available for the dielectric material whilst minimising the cavity size.

Another consideration is the fact that as the mode of the cavity increases, more of the electromagnetic radiation is contained within the dielectric material. Effectively, this results in a decreased ability to tune the operating frequency by varying the size of the cavity. The modes TM(5,1,d) and TE(6,1,d) are considered to provide an excellent compromise between the tunability of the cavity and the loss within the cavity.

Further, in accordance with the present invention the effects of the radiation losses from the dielectric material are reduced by placing the dielectric material within an electrically conductive cavity. This can be achieved by making the base lid and cylindrical wall of the resonant cavity from a highly electrically conductive material such as copper or silver.

Alternatively , the base, lid and cylindrical wall of the resonant cavity may be plated with highly conductive material such as copper, silver or gold to an appropriate thickness. It has been found that 20 microns is sufficient for most applications. Silver is generally preferred as it exhibits the lowest resistivity.

Still further, reduction of the radiation losses in the dielectric material can be achieved by choosing a low loss dielectric material with one or more of the following desirable properties: low loss tangent, moderate or high dielectric constant, small temperature coefficient of expansion, small temperature coefficient of dielectric constant, high Youngs modulus and high dielectric strength. Whilst the preferred form of dielectric material is pure sapphire, other materials may be used in the construction of such a resonator. Some other suitable materials are barium titanate, quartz, doped quartz, YIG (Yittrium Indium Garnate), YAG (Yittrium Aluminium Garnate), lithium niobate and lanthinate.

Further, it may be preferable to dope the dielectric material with selected atomic species to alter certain characteristics of the dielectric material to improve the resonator performance. As an example, it may be advantageous to introduce selected paramagnetic species of atom into the sapphire lattice to a determined doping level. This paramagnetic species will interact with the microwave resonance of the resonator and result in the resonator having a generally reduced frequency dependence on temperature.

Now describing the method of arriving at the geometry for a microwave cavity resonator, it has been found that a diameter of 21.68 mm and height 20.58 mm is desirable for a sapphire dielectric material operating in TM(5,1,d) mode at 10 GHz. This value was determined by solving Maxwell's equations in known manner. Having obtained a first value by solution of Maxwell's equations, it is possible to obtain diameters for pieces of dielectric material operating in other modes by the following process.

Firstly, a resonator using the piece of dielectric material of 21.68 mm diameter is built. The resonator is operated at a temperature close to the desired operating temperature of the cavity to be made. The resonator should have the same ratios for the heights and diameters at the desired cavity, and should be within the tunable range for the desired operating mode, for example between 1.65 and 2.00 for the ratio of diameters of a cavity desired to operate in TM(5,1,d) mode. Next, the resonant frequency of the resonator for the desired operating mode is measured using known means. By measuring this frequency, it is possible to determine to within machining tolerances, the diameter of a piece of dielectric material which will operate in the desired mode at the desired frequency. This is possible since the diameter of the dielectric material is proportional to resonant frequency, thus calculation of the necessary diameter of the dielectric material is by a simple ratio. That is, by dividing the calculated resonant frequency of the sample dielectric material by the desired operating frequency and multiplying the result by the diameter of the sample dielectric material, it is possible to arrive at an approximate diameter for the desired microwave resonator.

However, since machining of dielectric materials has inherent inaccuracies, the desired operating frequency and the actual operating frequency of the dielectric material will be somewhat different. To overcome this problem, it is possible to tune the resonant frequency of the microwave resonator by altering the ratio of the radius of the cavity walls to the radius of the dielectric material.

Figure 15:
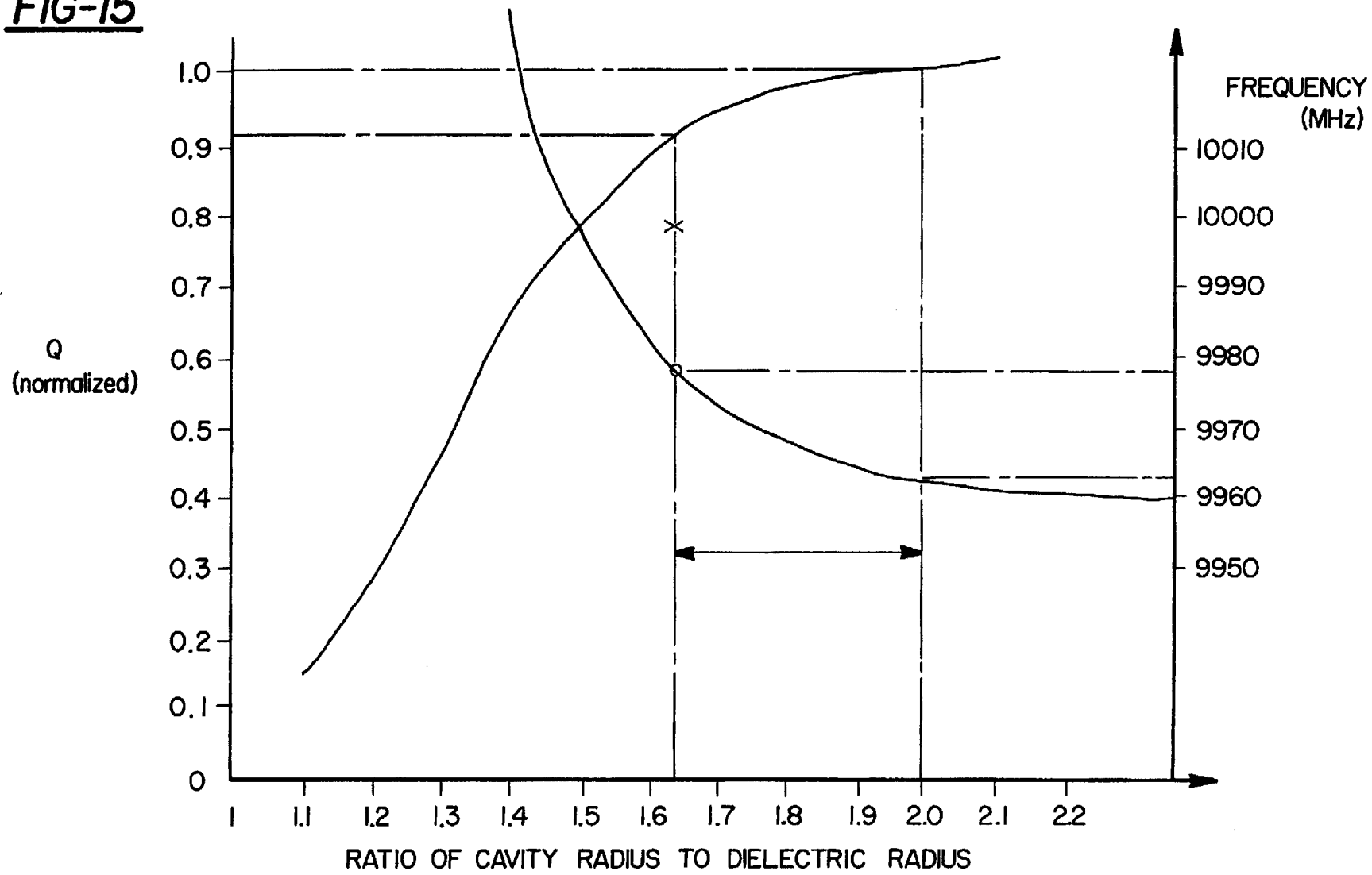
FIG. 15 is a graph showing the relationship between the ratio of the radii of the cavity and the dielectric material to the operating frequency of the resonator and the loss factor of the resonator system for a resonator operating in TM(5, 1,d) mode.

FIG. 15 is a graph representing the variation of resonant (curve f) frequency with variation of the abovementioned ratio and the loss in Q-factor (curve Q) associated with this change for a cavity operating in TM(5,1,d) mode. In this graph, the horizontal axis represents the ratio between the radius of the cavity and the radius of the dielectric material. The left vertical axis represents the normalised Q-factor obtainable. The right vertical graph represents the operating frequency, in MHz, of the cavity. It is considered preferable to operate within the range of 1.65 to 2.00 for the ratio of the radii of the cavity to the piece of dielectric material for TM(5,1,d) mode. This gives a tuning range of approximately 15 MHz at a resonant frequency of 10 GHz but only sacrifices 10% of the Q-factor. This is considered an acceptable loss in Q-factor in order to achieve greater tunability of the microwave resonator.

Thus, once the dielectric material has been machined to the diameter calculated above, the resonant frequency of the dielectric material is measured. By calculating the discrepancy in the actual resonant frequency and the desired resonant frequency, it is possible to adjust the radius of the cavity walls to compensate for the machining discrepancy in the dielectric material by referring to FIG. 15. For example, by making the initial measurement with the ratio of the radii being equal to 2.0 and by machining the sapphire so that the resonant frequency is slightly below that which is desired is possible simply by decreasing the ratio of the radii to increase the resonant frequency by up to 15 megahertz.

Figure 14:
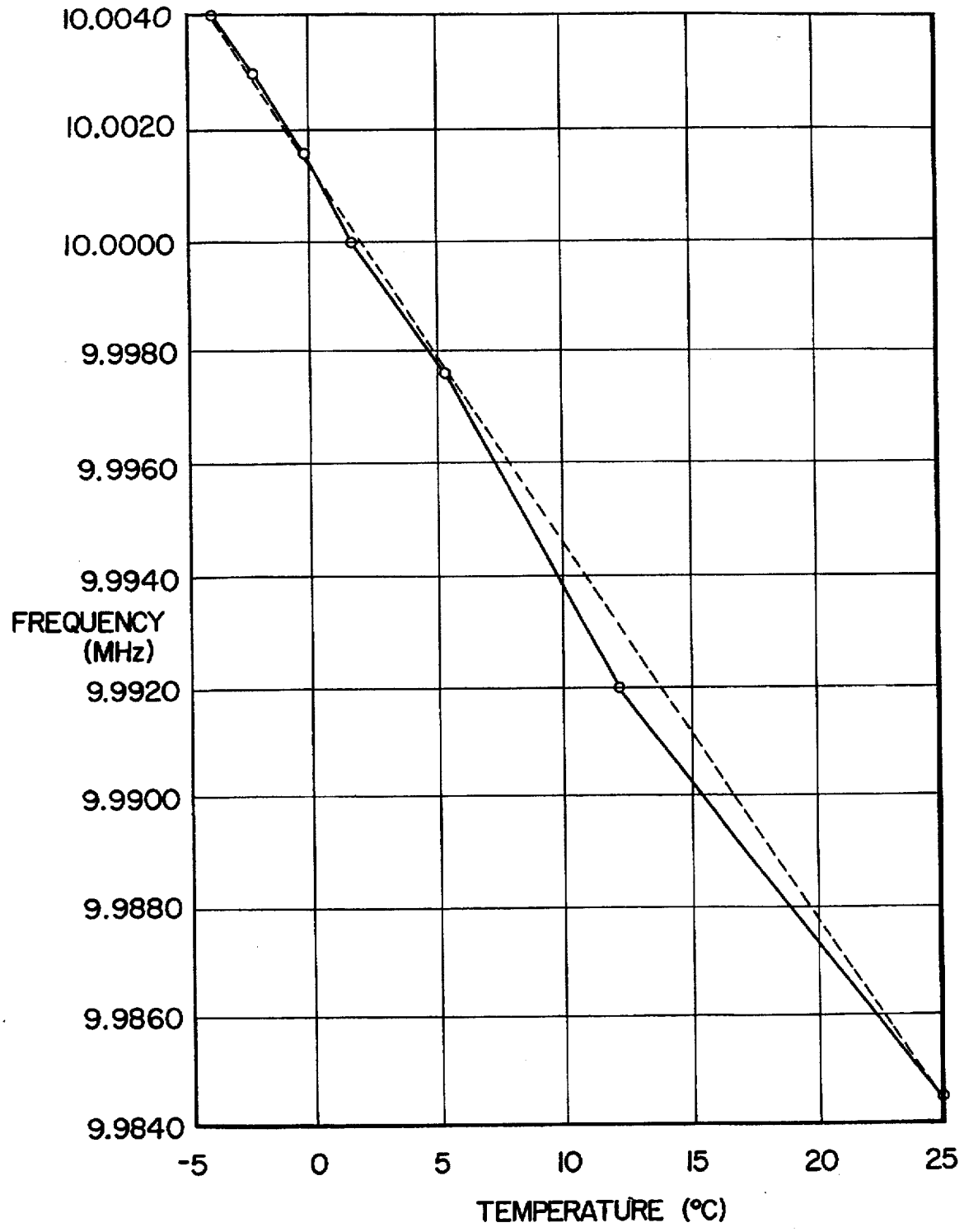
FIG. 14 is a graph showing the variation of frequency of a sapphire loaded cavity microwave resonator (TM(5,1,d)) operating at 10 GHz versus the operating temperature of the resonator in degrees Celsius.

One final piece of tuning is achieved by adjusting the operating temperature of the resonant cavity. Shown in FIG. 14 is a graph of the change in resonant frequency for a sapphire dielectric material for various temperatures. The horizontal axis has units degrees Celcius. The vertical axis is the operating frequency of the cavity, in GHz. It can be seen from the graph that sapphire has a temperature co-efficient of approximately 671 KHz per degree Celsius. By maintaining the temperature of the resonant cavity to within 1/1000th of a degree Celsius, it is possible to tune the resonant cavity to have a resonant frequency that is accurate to within one part per million.

As the above process is carried out for multiple modes, a library of information can be made to simplify the design of similar cavities.

Figure 16:
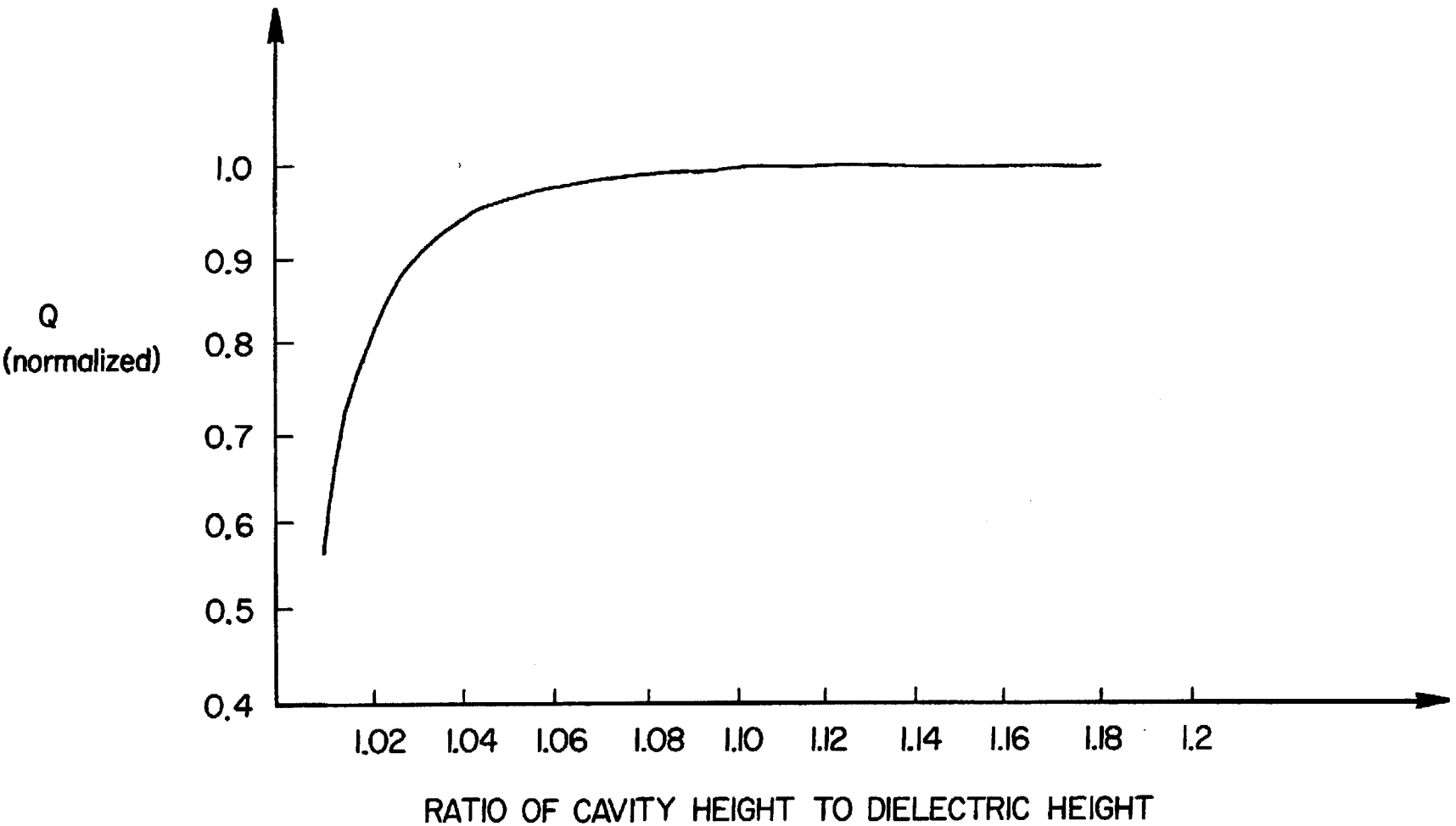
FIG. 16 is a graph showing the relationship between the ratio of the height of the cavity and the dielectric material to the loss factor of the resonator system for a resonant cavity operating in TM(5,1,d) mode.

FIG. 16 is a graph showing how the losses within the cavity is related to the ratio of the height of the metal cavity to the height of the piece of dielectric material for a cavity operating in TM(5,1,d) mode. The horizontal axis is the ratio of the height of the cavity to the height of the dielectric material. The vertical axis represents the maximum normalised Q-factor obtainable for the cavity. To ensure that the ratio of the heights has a minimal effect on the losses within the resonant cavity, it is desirable to operate in the region of FIG. 16 where the graph is close to 1.0. For example, where the ratio of the heights is well above 1.2, preferably approximately 1.6. It is possible to tune a cavity by altering the ratio of the heights of the cavity and the dielectric material.

Figure 17:
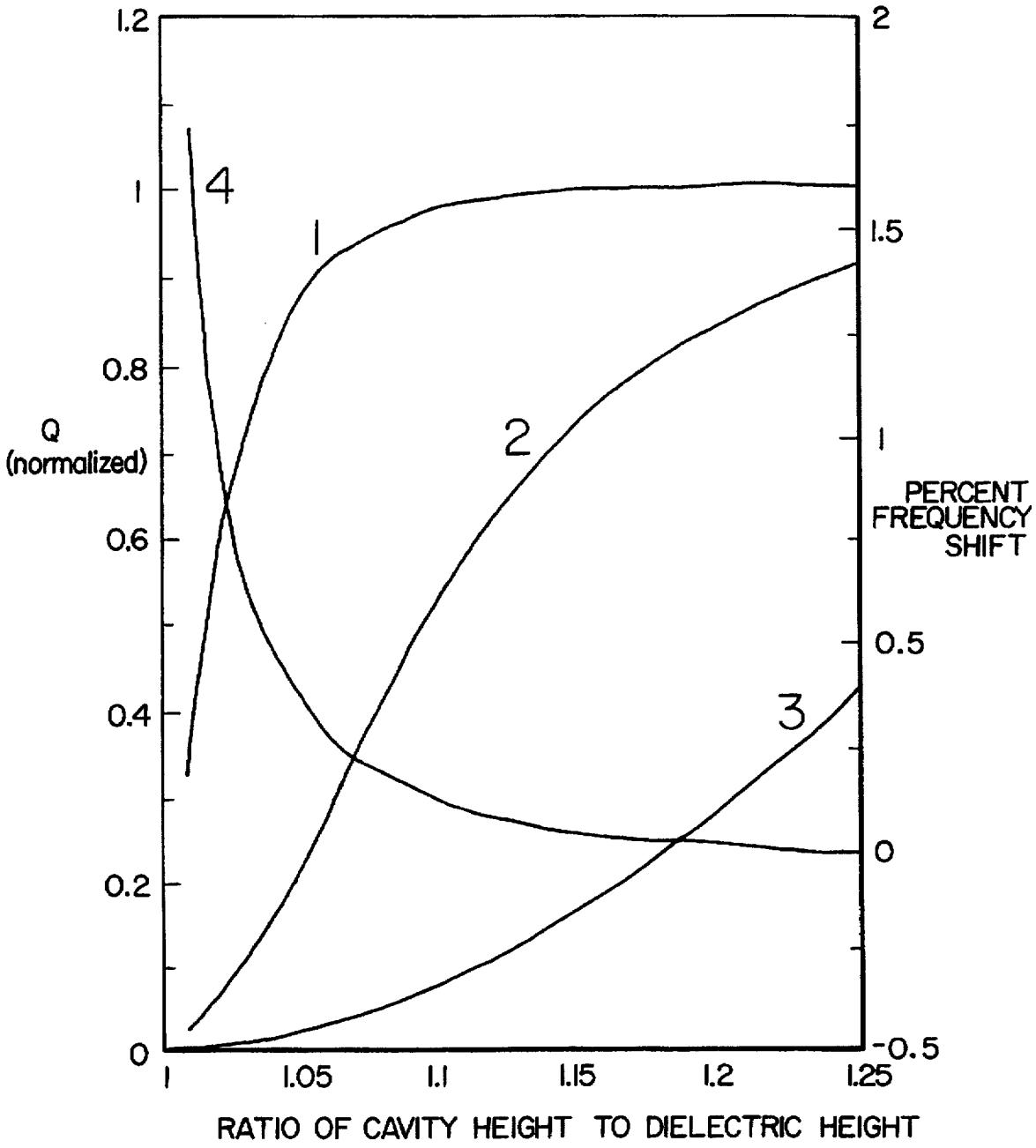
FIG. 17 is a graph showing the relationship between the ratio of the heights of the cavity and the dielectric material to the operating frequency of the resonator and the loss factor of the resonator system for a resonant cavity operating in TM(8,1,d) mode.

FIG. 17 shows the effect on resonant frequency and cavity losses of altering the ratio of the heights for a resonator operating in TM(8,1,d) mode for various conditions. The horizontal axis represents the ratio of the height of the cavity to the height of the dielectric material. The left vertical axis is the normalised Q-factor obtainable within the cavity. The right vertical axis show the relative frequency shift of the operating frequency in percent. The curve labelled 1 is for a cavity operating at a temperature of 20 degrees Celcius. The ratio of the radii was 1.7 and the resonator had a copper shield. The curve labelled 2 is the normalized Q-factor for a cavity operating at a temperature of 4.2 Kelvin. The ratio of the radii was 1.9 and the resonator had a niobium shield. The curve labelled 3 is the normalized Q-factor for a cavity operating at a temperature of 4.2 Kelvin. The ratio of the radii was 2.2 and the resonator had a copper shield. The curve labelled 4 shows how the operating frequency changes with the ratio of the heights. Curve 4 is equally applicable to curves 1, 2 and 3.

From FIG. 17 it can be seen that the tunable range achieved by altering the heights in a resonator operating in a transverse magnetic mode is less than that achieved by altering the diameter for the same cavity loss. Thus, it is preferred to alter the ratio of the diameters in a TM mode cavity. In a TE mode cavity, the ratio of the heights will give the greatest tuning range for the same cavity loss.

Figure 18:
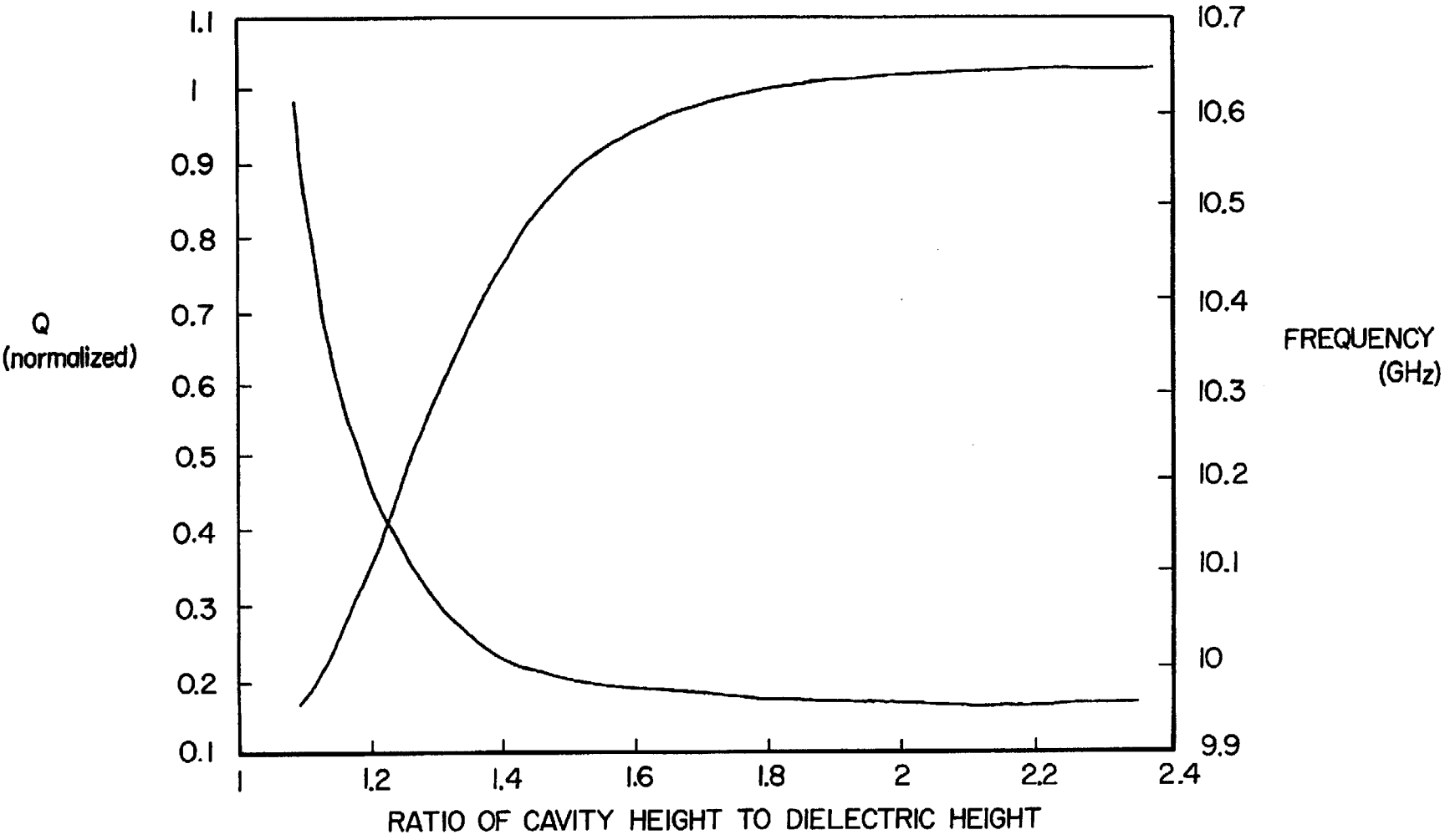
FIG. 18 is a graph showing the relationship between the ratio of the height of the cavity and the dielectric material to the operating frequency of the resonator and the loss factor of the resonator system for a resonator operating in TM(5, 1,d) mode.
Figure 19:
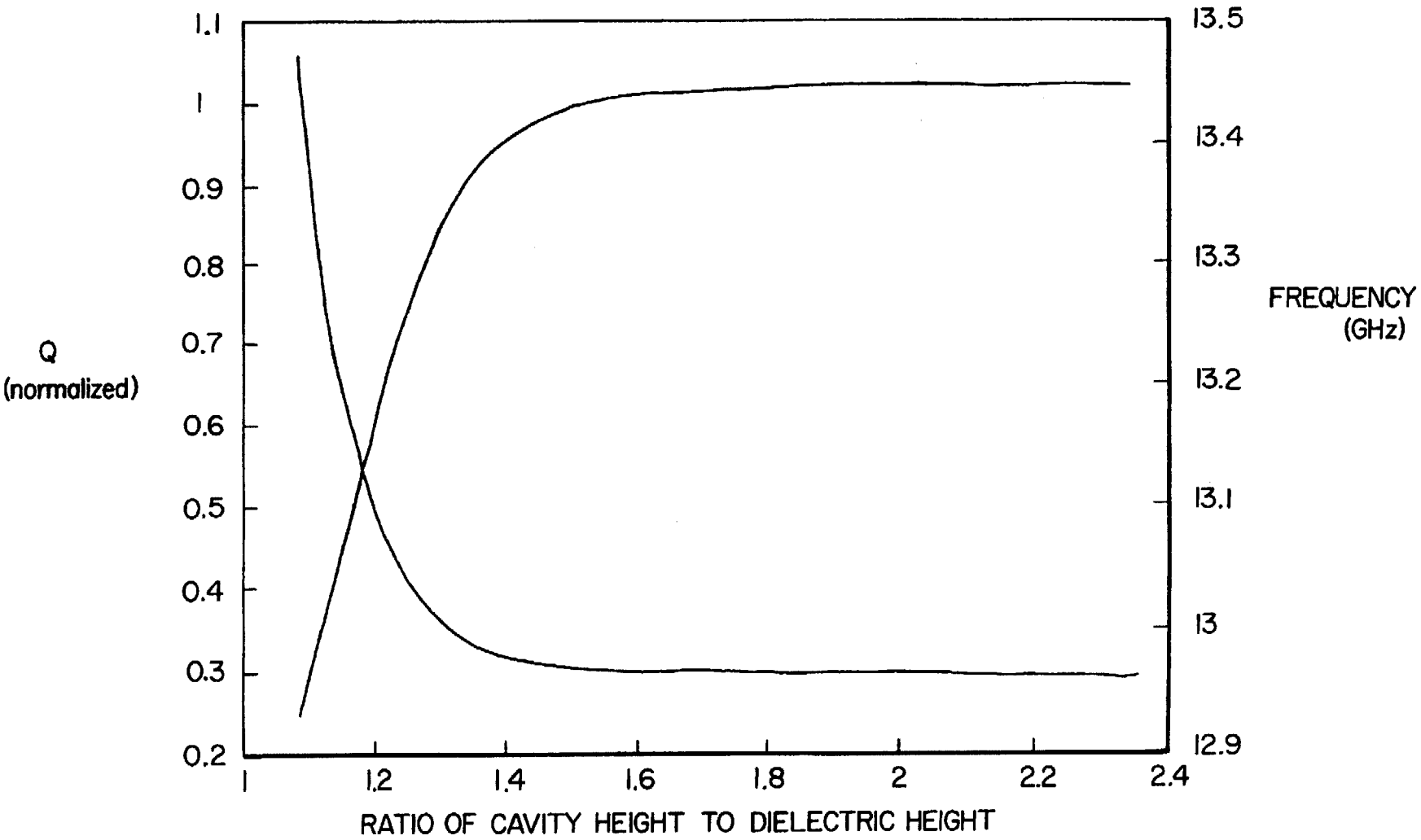
FIG. 19 is a graph showing the relationship between the ratio of the radii of the cavity and the dielectric material to the operating frequency of the resonator and the loss factor of the resonator system for a resonator operating in TM(7, 1,d) mode.
Figure 20:
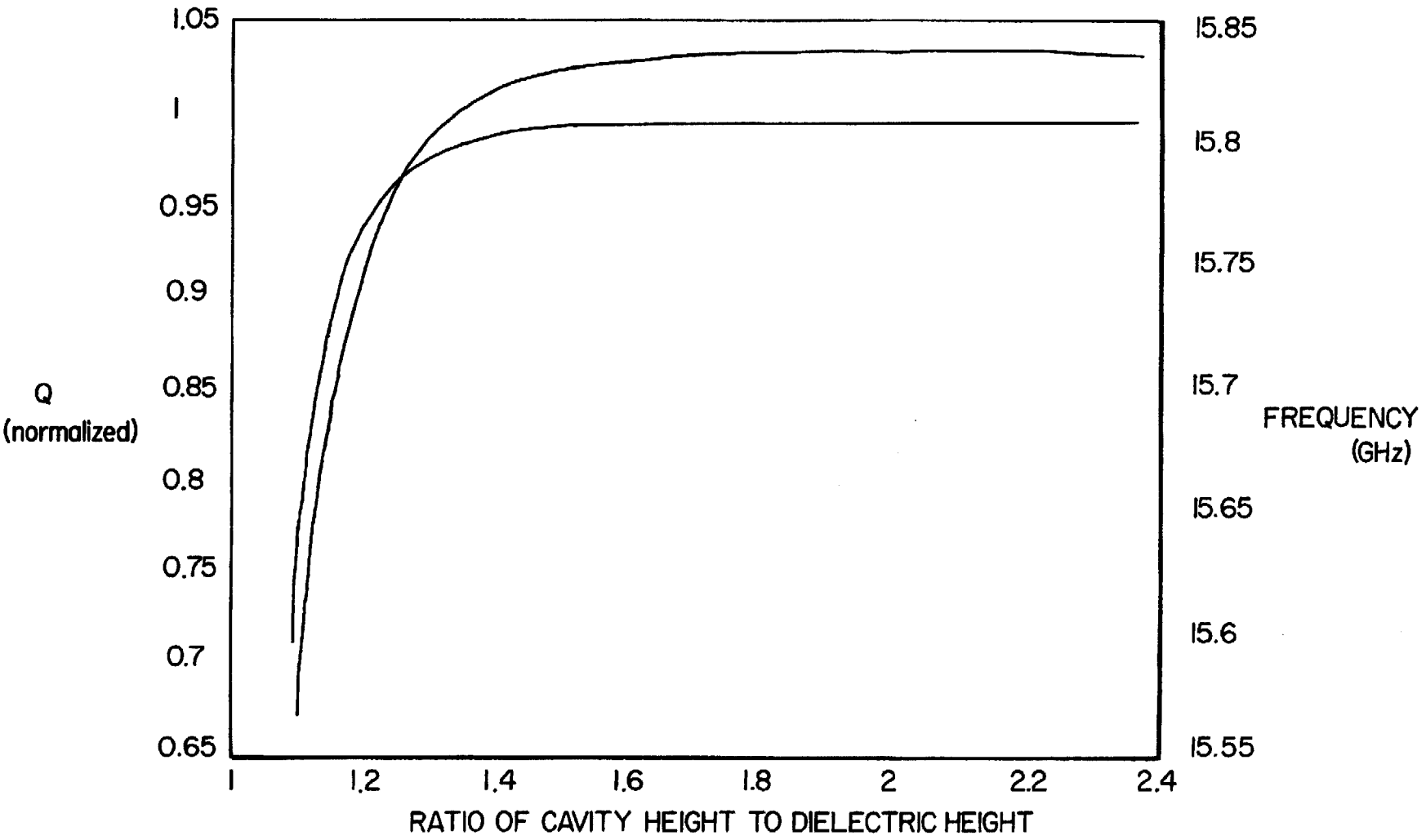
FIG. 20 is a graph showing the relationship between the ratio of the radii of the cavity and the dielectric material to the operating frequency of the resonator and the loss factor of the resonator system for a resonator operating in TE(7, 1,d) mode.

FIGS. 18, 19 and 20 show the effect on resonant frequency (curve f) and cavity resonator losses (curve Q) of altering the ratio of the heights for a resonator operating in various modes. The horizontal axes represents the ratio of the height of the cavity to the height of the dielectric material. The left vertical axes is the normalised Q-factor obtainable within the cavity resonator. The right vertical axes show the operating frequency of the cavity resonator in GHz. FIG. 18 shows this relationship for a cavity resonator operating in TM(5,1,d) mode, FIG. 19 shows a cavity resonator in TM(7,1,d) mode and FIG. 20 shows a cavity resonator operating in TE(7,1,d) mode. The information for FIGS. 18, 19 and 20 was derived at a temperature of 20 degrees Celcius, with a piece of sapphire dielectric material of 21.67 mm diameter and 20.58 mm height, and the ratio of the heights of the cavity to the sapphire was 1.2.

To obtain the maximum performance from the cavity it is neccessary to rotate the piece of dielectric material with respect to the ports 18. This is because the piece of dielectric material is not a perfect cylinder, or the dielectric material axis is not exactly aligned with the cylinder axis, or the dielectric material may have defects in its crystal structure due to manufacturing limitations. Thus there may be some positions for which the performance of the resonator is better due to the orientation of the piece of dielectric material. This adjustment is made by having the cavity in operation and observing the effect of rotating the piece of dielectric material with respect to the ports.

Figure 6:
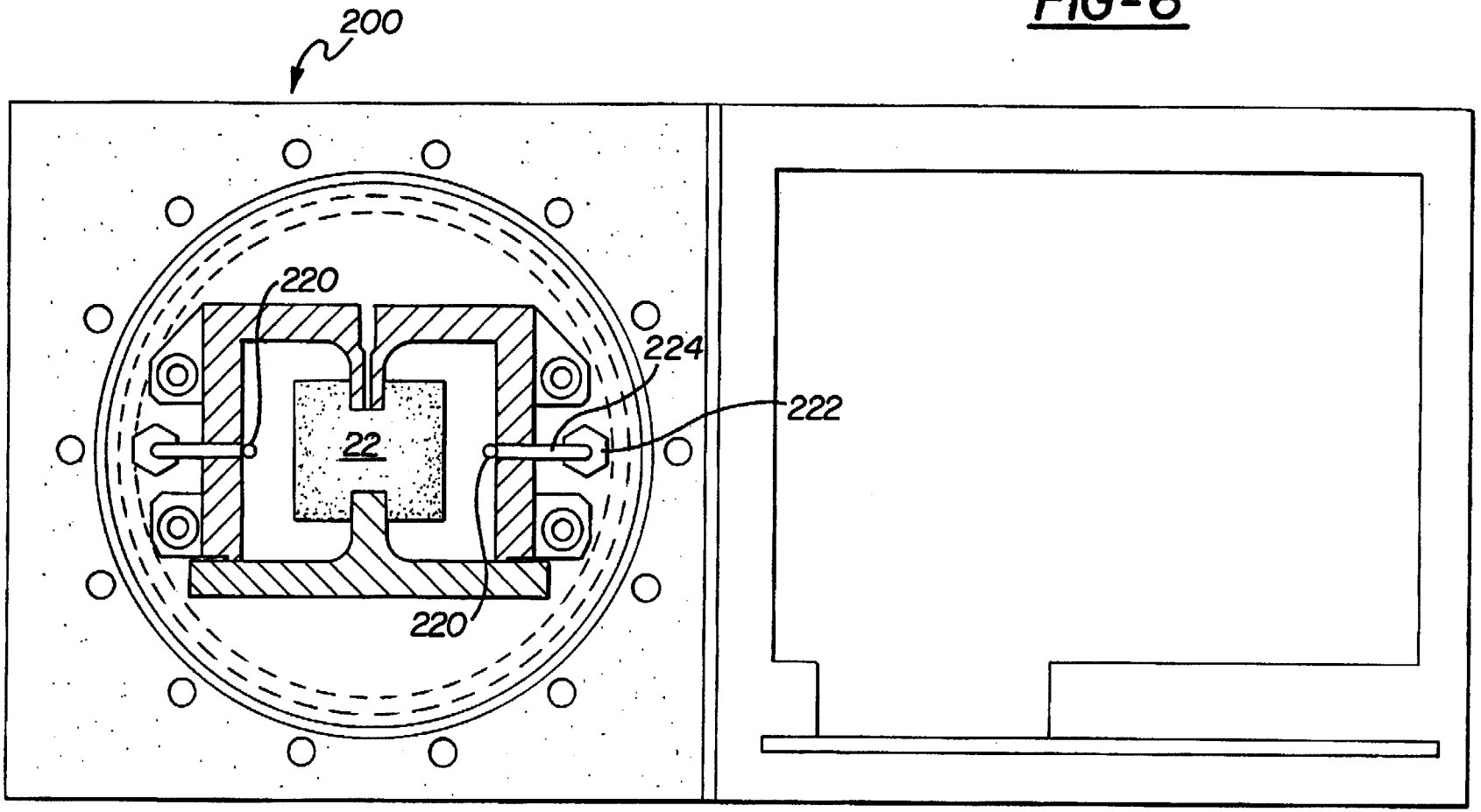
FIG. 6 is a side view of a microwave resonator in accordance with sixth embodiment the present invention.
Figure 7:
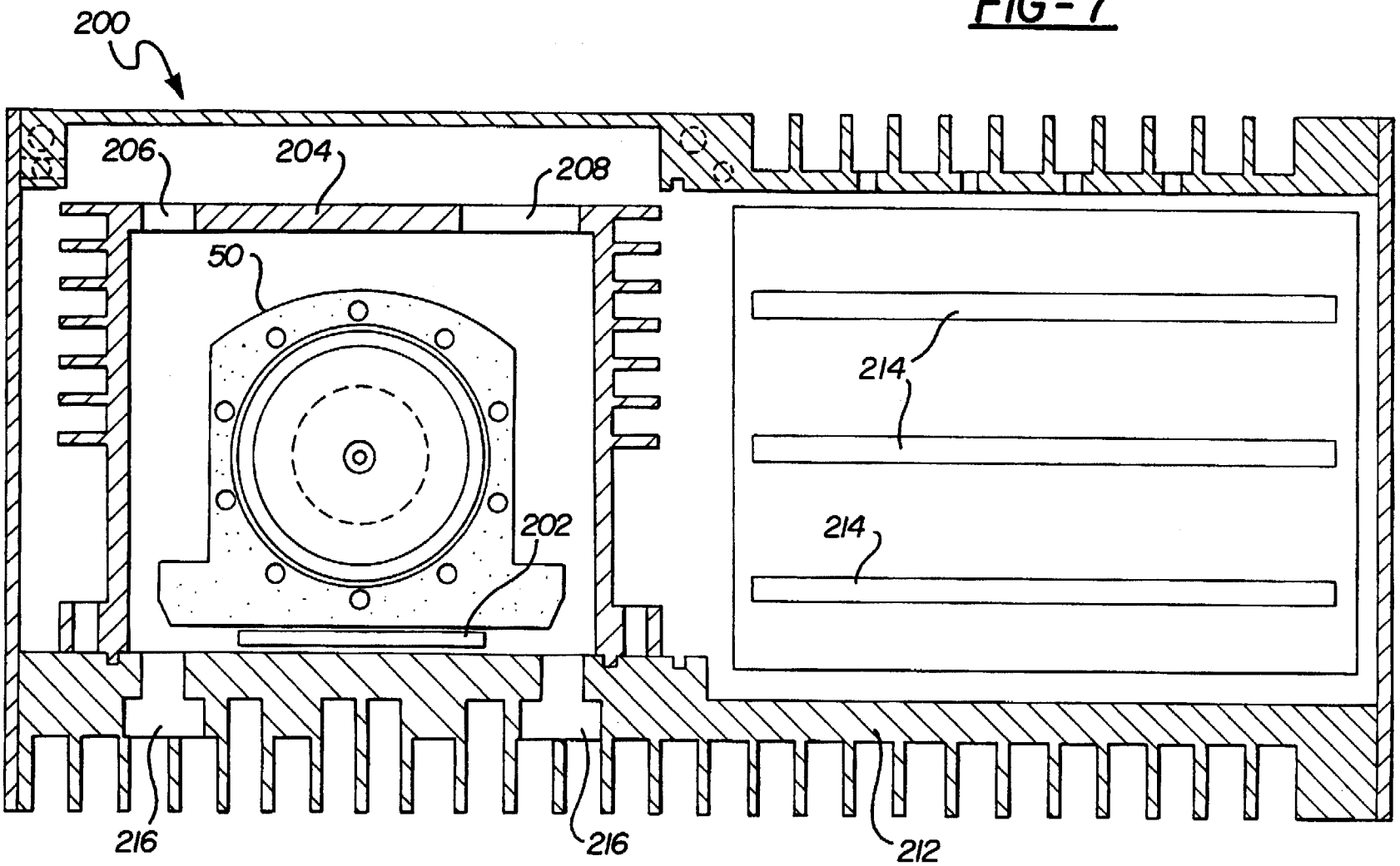
FIG. 7 is a plan view of the microwave resonator shown in FIG. 6.

In FIGS. 6 and 7 of the accompanying drawings, there is shown a microwave resonator 200 incorporating the microwave resonant cavity 50 of FIG. 3, with like numerals denoting like parts. It is to be appreciated that any of the microwave resonant cavities 10,30,50,70, or 90 could be used.

To reduce the effects of temperature variations on the frequency of operation, there is provided a cooling means 202 and a vacuum canister 204 mounted onto an enclosure 212. To allow the evacuation of the vacuum canister 204 there is provided a vacuum pump-out port 206. There is also provided a hermetic feed through 208 in the vacuum canister 204 to allow cabling to pass through the vacuum canister 204. By placing the cavity 50 within the vacuum canister 204, the cavity 50 is evacuated, effectively insulating the cavity 50 against variations in ambient temperature.

Cooling means 202 is preferably a compact device, such as a Peltier heat pump. The cooling means 202 is held between the cavity 50 and the enclosure 212 to allow heat transfer therebetween. In this embodiment of the present invention, the enclosure 212 acts as a heat sink. Cooling the cavity 50 gives an increase in resonator performance. The cooling means 202 is controlled by a thermal stabiliser circuit 214, allowing the temperature of the cavity 50 to be maintained, within acceptable tolerances, at a constant temperature, further improving the temperature stability of the resonator 200. To provide still further insulation, it is possible to wrap the cavity 50 in a multi-layer super insulation, of known type.

To facilitate the transfer of microwave radiation between the dielectric material 22 and the ports 18, the ports 18 are terminated within the cavity 50 by known microwave field probes 220. Access to the ports 18 is provided by external connectors 222 attached to the enclosure 212. There is a hermetic port 216 for each external connector 222 to ensure there is no loss of the vacuum within the vacuum cannister 204. Each connector 222 is linked to a ports 18 by a suitable microwave conductor 224, such as co-axial cable or a microwave waveguide.

Figure 8:
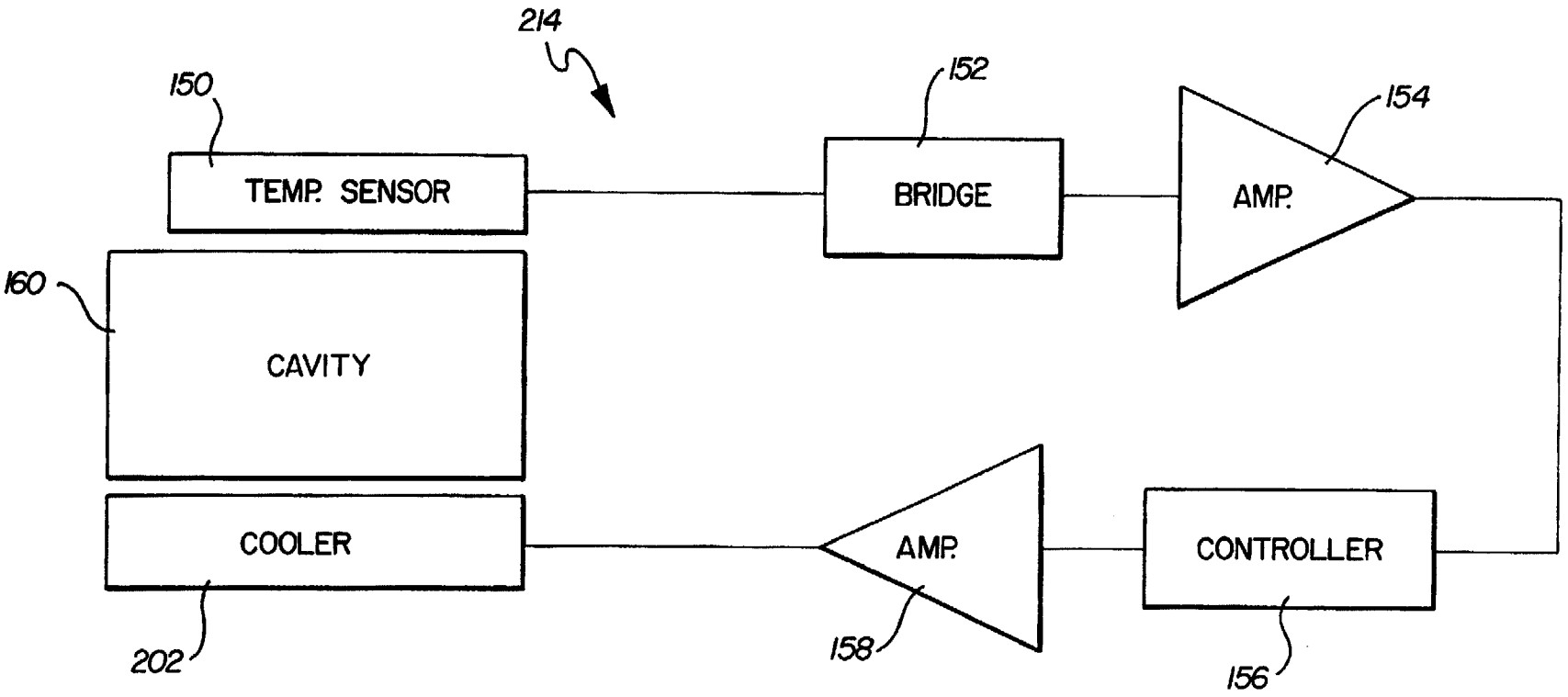
FIG. 8 is a schematic block diagram of one embodiment of a temperature controller for use in microwave resonators of any one of the aforementioned embodiments thereof.

Shown in FIG. 8 of the accompanying drawings is a block diagram of a temperature stabiliser circuit 214. The temperature stabiliser circuit 214 comprises a temperature sensor 150, a bridge 152, lock-in amplifier 154 and a proportional, integral and differential controller 156 and servo amplifier 158. There is also shown a cavity 160. The cavity 160 could be any of the cavities 10, 30, 50, 70 or 90 of the present invention. The temperature sensor 150, bridge 152, lock-in amplifier 154, controller 156 and servo amplifier 158 form a single stage closed loop controller of well known type.

Figure 9:
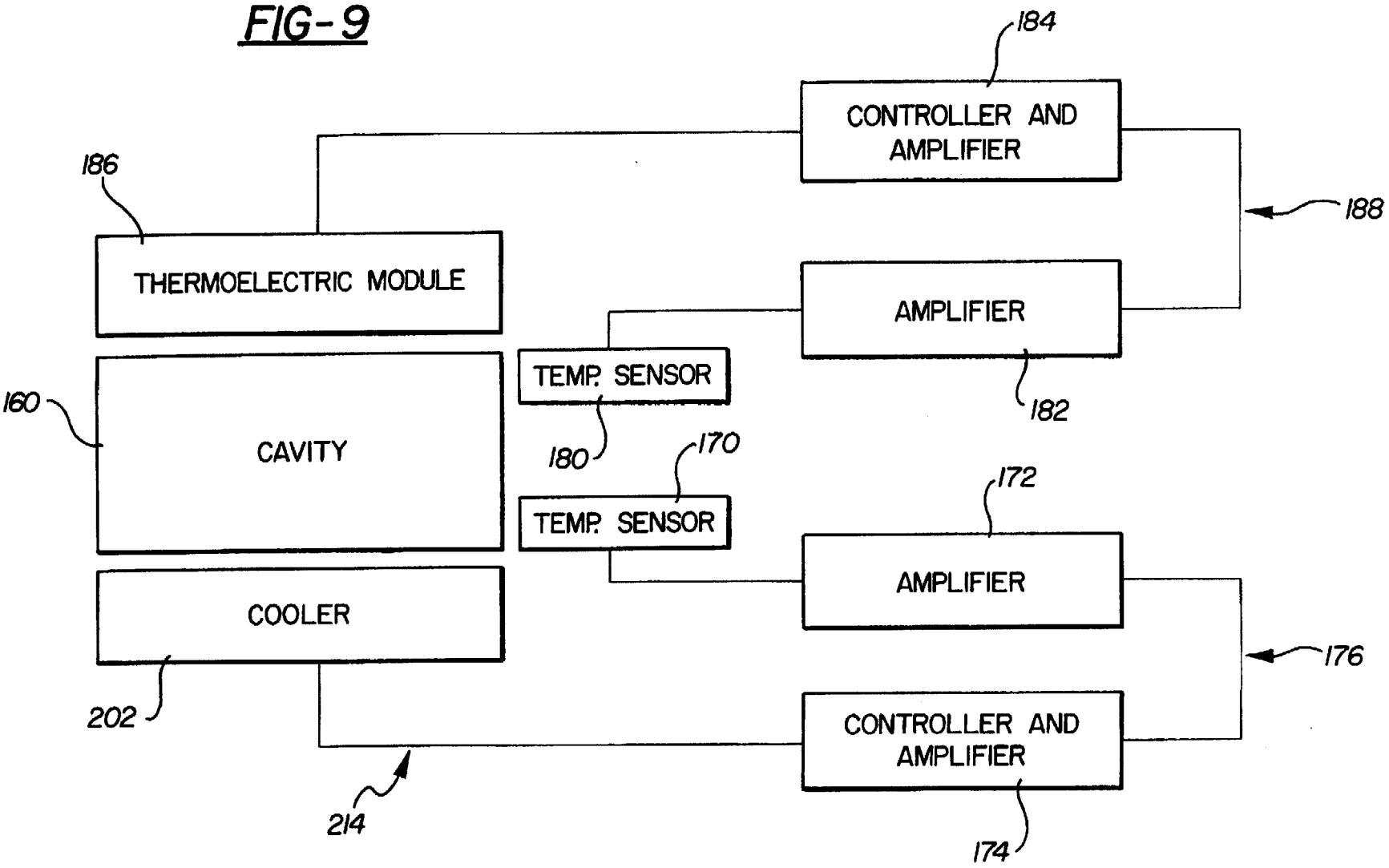
FIG. 9 is a schematic block diagram of an alternative temperature control for use in microwave resonators of any one of the aforementioned embodiments thereof.

As shown in FIG. 9 of the accompanying drawings is a block diagram of an alternative embodiment of a temperature stabiliser circuit 214. Again, there is shown a cavity 160 which may correspond to any of the cavities 10, 30, 50, 70 or 90 of the present invention. In this embodiment, which is a dual, stage controller, there are two separate single stage closed loop controllers, a coarse controller 176 and a fine controller 188. The coarse controller 176 comprises a temperature sensor 170, a lock-in amplifier 172 and a PID and servo amplifier 174. The coarse controller 176 maintains the temperature of the microwave cavity to within a reletively narrow range, for example 0.1° C. The fine controller 188 comprises a temperature sensor 180, a lock-in amplifier 182, a PID and servo amplifier 184 and a fine heater or thermoelectric module 186. The temperature sensor 180 is used to sense the temperature of the piece of dielectric material 22 directly. The heater or thermoelectric module 186 is used to directly control the temperature of the piece of dielectric material 22.

Because the coarse controller 176 maintains a temperature of the microwave cavity to within a relatively small range, the fine controller 188 is thus made immune to changes in the ambient temperature. Hence the fine controller 188 can be made far more sensitive to small variations in temperature. Hence, the fine controller 188 is used to control far more accurately the temperature of the dielectric material 22. Thus the coarse controller 176 maintains an approximately constant temperature against variations in ambient temperature, while the fine controller 188 maintains the temperature of the piece of dielectric material to within a very narrow range. It is possible with the dual stage controller to control the temperature of the piece of dielectric material to within a few microdegrees Celcius.

In use, the microwave resonator 200 is attached to a signal source via connectors 222*a* as shown in FIGS. 6 and 7. The signal travels along the microwave conductor 224 and is emitted into the cavity 50. Any component of the signal whose frequency and mode does not correspond to a resonant frequency of the cavity 50 will be reflected at the field probe 220. Thus, the only components of the signal which are present within the cavity 50 are those which correspond to a resonant frequency of the cavity 50.

Most of the signal within the cavity 50 is contained within the dielectric material 22. Any leakages from the dielectric material 22 are either reflected from the wall 12 back into the dielectric material 22 or are absorbed by a field probe 220*b* and transmitted along a microwave conductor 224*b*. The signal which is sent along a microwave conductor 224 is used by the device to which the microwave resonator 200 is attached. Such devices include oscillators at microwave frequencies and filters.

The losses within the cavity 50 are reduced to losses within the dielectric material 22 and losses within the walls of the cavity 50. By making the walls of the cavity 50 from a low electrical resistance metal, such as copper or silver, losses within the walls become negligible. Thus, the losses are largely defined by the type of dielectric material 22. It has been found that sapphire is an extremely suitable material for this purpose, having a low loss tangent.

Further, the losses in both the metals and the dielectric are decreased at lower temperatures. The cooling means 202 is designed to provide cooling which is still near ambient temperature, between −80° C. and 50° C., compared with the cryogenic temperatures of prior art devices. Whilst cooling the present invention to cryogenic temperatures would yield still further improvements in performance, the performance of the resonator 200 is currently well in excess of existing devices.

We claim:

1. A dielectrically loaded cavity resonator including a dielectric disposed within a cavity, the resonator having a desired operating frequency and being dimensioned to operate at a moderate order azimuthal mode at said desired operating frequency; wherein said cavity is dimensioned relative to said dielectric and coupled so as to provide a Q-factor proximate or substantially commensurate to the maximum possible Q-factor of the resonator for a desired port coupling at said azimuthal mode.

2. A cavity resonator as claimed in claim 1, wherein said dielectric is aligned relative to the ports of the resonator so as to provide a maximum possible Q-factor.

3. A cavity resonator as claimed in claim 1, wherein said moderate order azimuthal mode is at least three.

4. A cavity resonator as claimed in claim 1, wherein said mode is a quasi transverse electric mode, a quasi transverse magnetic mode, or a quasi transverse hybrid mode.

5. A cavity resonator as claimed in claim 1, wherein said moderate order azimuthal mode is at least five for a quasi transverse magnetic mode, and at least six for a quasi transverse electric mode.

6. A cavity resonator as claimed in claim 1, wherein said desired operating frequency lies in the microwave frequency band.

7. A cavity resonator as claimed in claim 1, wherein said cavity is formed of material having good thermal conductivity.

8. A cavity resonator as claimed in claim 1, including cooling means held against said cavity to allow heat transfer therebetween.

9. A cavity resonator as claimed in claim 8, wherein said cooling means is a peltier heat pump.

10. A cavity resonator as claimed in claim 8, wherein said cooling means is controlled by a thermal stabilizer circuit for maintaining the temperature of said cavity within acceptable tolerances.

11. A cavity resonator as claimed in claim 10, wherein, said thermal stabilizer circuit comprises a single stage closed loop controller for operating said cooling means.

12. A cavity resonator as claimed in claim 11, wherein said single stage closed loop controller comprises a temperature sensor for sensing the temperature of said cavity, a bridge, a lock-in amplifier, a proportional-integral-differential (PID) controller, and a servo amplifier.

13. A cavity resonator as claimed in claim 11, wherein said thermal stabilizer circuit includes a further single stage closed loop controller, the first controller being a coarse controller for maintaining the temperature of said cavity within a relatively narrow range and said further controller being a fine controller for maintaining the temperature of said dielectric within a relatively narrow range.

14. A cavity resonator as claimed in claim 13, wherein said further single stage closed loop controller comprises a temperature sensor for directly sensing the temperature of said dielectric, a lock-in amplifier, a PID controller, a servo amplifier and a fine heater or thermoelectric module for directly controlling the temperature of said dielectric.

15. A cavity resonator as claimed in claim 1, wherein said cavity is disposed within a hermetically sealed vacuum canister for evacuation by a vacuum pump connected to said vacuum canister to insulate the cavity against variations in ambient temperature.

16. A cavity resonator as claimed in claim 15, wherein said vacuum canister and said cooling means are mounted onto an enclosure to further reduce the effects of temperature variations on the frequency of operation of the cavity resonator, and said cooling means is held between said cavity and said enclosure to allow for heat transfer therebetween.

17. A cavity resonator as claimed in claim 16, wherein said enclosure acts as a heat sink to facilitate cooling of said cavity.

18. A dielectrically loaded cavity resonator including a dielectric disposed within a cavity, the resonator having a desired operating frequency and being dimensioned to operate at a moderate order azimuthal mode at said desired operating frequency, wherein said dielectric is aligned relative to the ports of the resonator so as to provide a maximum possible Q-factor.

19. A cavity resonator as claimed in claim 18, wherein said moderate order azimuthal mode is at least three.

20. A cavity resonator as claimed in claim 18, wherein said mode is a quasi transverse electric mode, a quasi transverse magnetic mode, or a quasi transverse hybrid mode.

21. A cavity resonator as claimed in claim 18, wherein said moderate order azimuthal mode is at least five for a quasi transverse magnetic mode, and at least six for a quasi transverse electric mode.

22. A cavity resonator as claimed in claim 18, wherein said desired operating frequency lies in the microwave frequency band.

23. A cavity resonator as claimed in claim 18, wherein said cavity is formed of material having good thermal conductivity.

24. A cavity resonator as claimed in claim 18, wherein cooling means held against said cavity to allow heat transfer therebetween.

25. A cavity resonator as claimed in claim 24, wherein said cooling means is a peltier heat pump.

26. A cavity resonator as claimed in claim 24, wherein said cooling means is controlled by a thermal stabilizer circuit for maintaining the temperature of said cavity within acceptable tolerances.

27. A cavity resonator as claimed in claim 26, wherein said thermal stabilizer circuit comprises a single stage closed loop controller for operation said cooling means.

28. A cavity resonator as claimed in claim 27, wherein said single stage closed loop controller comprises a temperature sensor for sensing the temperature of said cavity, a bridge, a lock-in amplifier, a proportional-integral-differential (PID) controller, and a servo amplifier.

29. A cavity resonator as claimed in claim 27, wherein said thermal stabilizer circuit includes a further single stage closed loop controller, the first controller being a coarse controller for maintaining the temperature of said cavity within a relatively narrow range and said further controller being a fine controller for maintaining the temperature of said dielectric within a relatively narrow range.

30. A cavity resonator as claimed in claim 29, wherein said further single stage closed loop controller comprises a temperature sensor for directly sensing the temperature of said dielectric, a lock-in amplifier, a PID controller, a servo amplifier and a fine heater or thermoelectric module for directly controlling the temperature of said dielectric.

31. A cavity resonator as claimed in claim 18, wherein said cavity is disposed within a hermetically sealed vacuum canister for evacuation by a vacuum pump connected to said vacuum canister to insulate the cavity against variations in ambient temperature.

32. A cavity resonator as claimed in claim 31, wherein said vacuum canister and said cooling means are mounted onto an enclosure to further reduce the effects of temperature variations on the frequency of operation of the cavity resonator, and said cooling means is held between said cavity and said enclosure to allow for heat transfer therebetween.

33. A cavity resonator as claimed in claim 32, wherein said enclosure acts as a heat sink to facilitate cooling of said cavity.

34. A cavity resonator as claimed in claim 1 wherein said dielectric comprises a cylindrical portion to substantially confine electromagnetic energy therein and opposing axial ends particularly shaped to be fixedly disposed centrally within the cavity of the resonator; wherein said opposing axial ends are each provided with a coaxially aligned recess, projecting inwardly of said cylindrical portion, said recesses being provided for fixed engagement by opposing ends of the cavity to centrally dispose the dielectric within the cavity of the resonator.

35. A cavity resonator as claimed in claim 1 wherein said dielectric is formed of a material having one or more of the following properties: low loss tangent, moderate or high dielectric constant, small temperature coefficient of expansion, small temperature coefficient of dielectric constant, high Youngs modulus, and high dielectric strength.

36. A cavity resonator as claimed in claim 1 wherein said dielectric is formed of pure sapphire.

37. A cavity resonator as claimed in claim 1 wherein said dielectric is formed of barium titanate, quartz, doped quartz, Yittrium Indium Garnate (YIG), Yittrium Aluminum Garnate (YAG), or lithium niobate.

38. A cavity resonator as claimed in claim 1 wherein said dielectric is doped with selected atomic species for altering certain characteristics of the dielectric material to improve its performance when used in a cavity resonator.

39. A cavity resonator as claimed in claim 38 wherein said selected atomic species is a selected paramagnetic species of atom and said dielectric material is sapphire.

40. A cavity resonator as claimed in claim 1 wherein said dielectric has a diameter and a height determined by solving Maxwell's equations for a prescribed material intended to operate in a prescribed mode at a prescribed frequency, at a prescribed temperature.

41. A cavity resonator as claimed in claim 1 wherein the height of the dielectric is greater than the diameter thereof.

42. A cavity resonator as claimed in claim 1, said cavity including:

a cylindrical wall;

a pair of opposing axial ends; and a plurality of ports, at least one port being for delivering electromagnetic energy thereto and at least one other port being for receiving electromagnetic energy therefrom;

wherein said opposing axial ends are particularly shaped to fixedly engage the opposing axial ends of a dielectric and dispose said dielectric centrally therein.

43. A cavity resonator as claimed in claim 42 wherein said opposing axial ends each have an axial stem disposed on the inner surface thereof for axial alignment and projecting axially inwardly of the cavity so as to fixedly engage and centrally disposed the dielectric therein.

44. A cavity resonator as claimed in claim 43 for a dielectric provided with a coaxially aligned spindle at each opposing end thereof, integral with the cylindrical portion of the dielectric, wherein the free ends of said axial stem each have a cylindrical recess disposed on the axial end thereof for axial alignment and being of corresponding cross sectional size and shape to the free ends of the spindles, so as to accommodate and fixedly dispose the free ends of the spindles therein.

45. A cavity resonator as claimed in claim 43 wherein the free end of each said axial stem is of corresponding cross sectional size and shape to the respective coaxially aligned recess of the dielectric, so as to be accommodated therein and fixedly dispose the dielectric centrally within the cavity, thereupon.

46. A cavity resonator as claimed in claim 45 wherein each of said axial stems have an axial vent disposed therein and communicating with said free end thereof to facilitate in evacuating air from the coaxially aligned recess thereof.

47. A cavity resonator as claimed in claim 43 for a dielectric having the coaxially aligned recesses thereof intersecting so as to form a through hole, wherein said axial stems are part of a single cylindrical stem for fixedly engaging and being accommodated within the axially extending cylindrical hole of the dielectric, the hole engaging portion of said single cylindrical stem being of corresponding cross sectional size and shape to the axially extending hole of the dielectric for fixedly disposing the dielectric centrally within the cavity, thereupon.

48. A cavity resonator as claimed in claim 47 wherein said single cylindrical stem extends axially inwardly of the cavity from one of said opposing axial ends through the other of said opposing axial ends, so that the free end of said single cylindrical stem is integrally accommodated within said other opposing axial end.

49. A cavity resonator as claimed in claim 47 wherein said single cylindrical stem has a hold extending axially therethrough for disposing a temperature probe therein in close proximity to the dielectric.

50. A cavity resonator as claimed in claim 42 including two discrete sections symmetrical about an axial plane, each section comprising corresponding half opposing axial ends, a half cylindrical wall, a confronting planar surface and corresponding recesses to accommodate the dielectric centrally therein, the dielectric being encapsulated within said sections on disposing said planar surface in mutual opposition.

51. A cavity resonator as claimed in claim 42 wherein a said opposing axial end of the cavity has a plurality of radially disposed slots with respect to the central axis of the cavity, said slots being disposed at positions which correspond to there being a low concentration of electromagnetic energy in the desired operating mode of the cavity resonator.

52. A cavity resonator as claimed in claim 42 having a diameter of the inner surface of said cylindrical wall of a magnitude such that the ratio of the diameter of said inner surface to the diameter of the dielectric for the cavity resonator formed thereby, falls within a range for providing an acceptable Q-factor a the desired mode, operating frequency and prescribed temperature of the cavity resonator.

53. A cavity resonator as claimed in claim 42 having a height of the inner surface of said cylindrical wall of a magnitude such &at the ratio of the height of said inner surface to the height of the dielectric falls within a range for providing an acceptable Q-factor at the mode the cavity is intended to operate as a cavity resonator at the desired operating frequency of the cavity resonator at a prescribed temperature.

54. A cavity resonator as claimed in claim 18 wherein said dielectric comprises a cylindrical portion to substantially confine electromagnetic energy therein and opposing axial ends particularly shaped to be fixedly disposed centrally within the cavity of the resonator; wherein said opposing axial ends are each provided with a coaxially aligned recess, projecting inwardly of said cylindrical portion, said recesses being provided for fixed engagement by opposing ends of the cavity to centrally dispose the dielectric within the cavity of the resonator.

55. A cavity resonator as claimed in claim 18 wherein said dielectric is formed of a material having one or more of the following properties: low loss tangent, moderate or high dielectric constant, small temperature coefficient of expansion, small temperature coefficient of dielectric constant, high Youngs modulus, and high dielectric strength.

56. A cavity resonator as claimed in claim 18 wherein said dielectric is formed of pure sapphire.

57. A cavity resonator as claimed in claim 18 wherein said dielectric is formed of barium titanate, quartz, doped quartz, Yittrium Indium Garnate (YIG), Yittrium Aluminum Carhate (YAG), or lithium niobate.

58. A cavity resonator as claimed in claim 18 wherein said dielectric is doped with selected atomic species for altering certain characteristics of the dielectric material to improve its performance when used in a cavity resonator.

59. A cavity resonator as claimed in claim 58 wherein said selected atomic species is a selected paramagnetic species of atom and said dielectric material is sapphire.

60. A cavity resonator as claimed in claim 18 wherein said dielectric has a diameter and a height determined by solving Maxwell's equations for a prescribed material intended to operate in a prescribed mode at a prescribed frequency, at a prescribed temperature.

61. A cavity resonator as claimed in claim 18 wherein the height of the dielectric is greater than the diameter thereof.

62. A cavity resonator as claimed in claim 18, said cavity including:

a cylindrical wall;

a pair of opposing axial ends; and a plurality of ports, at least one port being for delivering electromagnetic energy thereto and at least one other port being for receiving electromagnetic energy therefrom;

wherein said opposing axial ends are particularly shaped to fixedly engage the opposing axial ends of a dielectric and dispose said dielectric centrally therein.

63. A cavity resonator as claimed in claim 62 wherein said opposing axial ends each have an axial stem disposed on the inner surface thereof for axial alignment and projecting axially inwardly of the cavity so is to fixedly engage and centrally dispose the dielectric therein.

64. A cavity resonator as claimed in claim 63 for a dielectric provided with a coaxially aligned spindle at each opposing end thereof, integral with the cylindrical portion of the dielectric, wherein the free ends of said axial stem each have a cylindrical recess disposed on the axial end thereof for axial alignment and being of corresponding cross sectional size and shape to the free ends of the spindles, so as to accommodate and fixedly dispose the free ends of the spindles therein.

65. A cavity resonator as claimed in claim 63 wherein the free end of each said axial stem is of corresponding cross sectional size and shape to the respective coaxially aligned recess of the dielectric, so as to be accommodated therein and fixedly dispose the dielectric centrally within the cavity, thereupon.

66. A cavity resonator as claimed in claim 65 wherein each of said axial stems have an axial vent disposed therein and communicating with aid free end thereof to facilitate in evacuating air from the coaxially aligned recess thereof.

67. A cavity resonator as claimed in claim 63 for a dielectric having the coaxially aligned recesses thereof intersecting so as to form a through hole, wherein said axial stems are part of a single cylindrical stem for fixedly engaging and being accommodated within the axially extending cylindrical hole of the dielectric, the hole engaging portion of said single cylindrical stem being of corresponding cross sectional size and shape to the axially extending hole of the dielectric for fixedly disposing the dielectric centrally within the cavity, thereupon.

68. A cavity resonator as claimed in claim 67 wherein said single cylindrical stem extends axially inwardly of the cavity from one of said opposing axial ends through to the other of said opposing axial ends, so that the free end of said single cylindrical stem is integrally accommodated within said other opposing axial end.

69. A cavity resonator as claimed in claim 67, wherein said single cylindrical stem has a hole extending axially therethrough for disposing a temperature probe therein in close proximity to the dielectric.

70. A cavity resonator as claimed in claim 62 including two discrete sections symmetrical about an axial plane, each section comprising corresponding half opposing axial ends, a half cylindrical wall, a confronting planar surface and corresponding recesses to accommodate the dielectric centrally therein, the dielectric being encapsulated within said sections on disposing said planar surfaces in mutual opposition.

71. A cavity resonator as claimed in claim 62 wherein a said opposing axial end of the cavity has a plurality of radially disposed slots with respect to the central axis of the cavity, said slots being disposed at positions which correspond to there being a low concentration of electromagnetic energy in the desired operating mode of the cavity resonator.

72. A cavity resonator as claimed in claim 62 having a diameter of the inner surface of said cylindrical wall of a magnitude such that the ratio of the diameter of said inner surface to the diameter of the dielectric for the cavity resonator formed thereby, falls within a range for providing an acceptable Q-factor at the desired mode, operating frequency and prescribed temperature of the cavity resonator.

73. A cavity resonator as claimed in claim 62, having a height of the inner surface of said cylindrical wall of a magnitude such that the ratio of the height of said inner surface to the height of the dielectric falls within a range for providing an acceptable Q-factor at the mode the cavity is intended to operate as a cavity resonator at the desired operating frequency of the cavity resonator at a prescribed temperature.

74. A cavity resonator as claimed in claim 18 wherein said dielectric is aligned relative to the ports of the resonator to also minimize the coupling to unwanted doublet modes.

* * * * *

UNITED STATES PATENT AND TRADEMARK OFFICE

CERTIFICATE OF CORRECTION

PATENT NO. : 5,714,920

DATED : February 3, 1998

INVENTOR(S) : Eugene Nikolay Ivanov et al.

It is certified that error appears in the above-indentified patent and that said Letters Patent is hereby corrected as shown below:

Column 1, lines 9 and 10, delete "microwave resonator".

Column 2, line 53, insert -- FIG. 5 is a side view of a microwave resonant cavity in accordance with a fifth embodiment of the present invention; --.

Column 3, line 62, delete "12".

Column 4, line 31, delete "18".

Column 4, line 60, delete "stem" and insert therefor -- stems --.

Column 6, line 58, delete "100 recesses" and insert therefor -- recesses 100 --.

Column 7, line 20, after "is" insert -- decreased --.

UNITED STATES PATENT AND TRADEMARK OFFICE

CERTIFICATE OF CORRECTION

PATENT NO. : 5,714,920

DATED : February 3, 1998

INVENTOR(S) : Eugene Nikolay Ivanov et al.

It is certified that error appears in the above-indentified patent and that said Letters Patent is hereby corrected as shown below:

Column 7, line 37, delete "areasindicate" and insert therefor -- areas indicate --.

Column 8, line 28, after "and" insert -- dissipation --.

Column 8, line 37, delete "modes" and insert therefor -- Modes --.

Column 9, line 1, delete "normalized".

Column 9, line 1, after "the" insert -- normalized --.

Column 9, line 12, delete "resonant-cavity" and insert therefor -- resonant cavity --.

Column 9, line 32, delete "Alternatively ," and insert therefor -- Alternatively, --.

UNITED STATES PATENT AND TRADEMARK OFFICE

CERTIFICATE OF CORRECTION

PATENT NO. : 5,714,920
DATED : February 3, 1998
INVENTOR(S) : Eugene Ivanov et al.

It is certified that error appears in the above-indentified patent and that said Letters Patent is hereby corrected as shown below:

Column 12, line 61, after "dual" delete -- , --.

Column 12, line 66, delete "reletively" and insert therefor -- relatively --.

Column 17, claim 48, line 3, after "through" insert -- to --.

Column 17, claim 49, line 2, delete "hold" and insert therefor -- hole --.

Column 17, claim 53, line 3, delete "&at" and insert therefor -- that --.

Column 18, claim 57, lines 3 and 4, delete "Carhate" and insert therefor -- Garnate --.

Column 18, claim 63, line 40, delete "is" and insert therefor -- as --.

UNITED STATES PATENT AND TRADEMARK OFFICE

CERTIFICATE OF CORRECTION

PATENT NO. : 5,714,920

DATED : February 3, 1998

INVENTOR(S) : Eugene Ivanov et al.

It is certified that error appears in the above-indentified patent and that said Letters Patent is hereby corrected as shown below:

Column 18, claim 66, line 3, delete "aid" and insert therefor -- said --.

Column 18, claim 68, line 3, delete "to".

Column 19, claim 70, line 7, delete "surfaces" and insert therefor -- surface --.

Signed and Sealed this

Seventeenth Day of November, 1998

*Attest:*

Bruce Lehman

BRUCE LEHMAN

*Attesting Officer*

*Commissioner of Patents and Trademarks*